US012509848B2

(12) United States Patent
Sano et al.

(10) Patent No.: US 12,509,848 B2
(45) Date of Patent: Dec. 30, 2025

(54) SHOVEL AND CONTROL DEVICE FOR SHOVEL

(71) Applicant: SUMITOMO HEAVY INDUSTRIES, LTD., Tokyo (JP)

(72) Inventors: Yusuke Sano, Kanagawa (JP); Keiji Honda, Kanagawa (JP); Masaru Onodera, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 161 days.

(21) Appl. No.: 18/470,689

(22) Filed: Sep. 20, 2023

(65) Prior Publication Data

US 2024/0011241 A1 Jan. 11, 2024

Related U.S. Application Data

(63) Continuation of application No. PCT/JP2022/015224, filed on Mar. 28, 2022.

(30) Foreign Application Priority Data

Mar. 31, 2021 (JP) ..... 2021-060297
Mar. 31, 2021 (JP) ..... 2021-062318

(51) Int. Cl.

| | |
|---|---|
| ***E02F 3/00*** | (2006.01) |
| ***E02F 3/30*** | (2006.01) |
| ***E02F 3/32*** | (2006.01) |
| ***E02F 3/43*** | (2006.01) |

(52) U.S. Cl.

CPC ..... *E02F 3/431* (2013.01); *E02F 3/302* (2013.01); *E02F 3/307* (2013.01); *E02F 3/32* (2013.01)

(58) Field of Classification Search

CPC . E02F 3/431; E02F 3/302; E02F 3/307; E02F 3/32

USPC ..... 701/50

See application file for complete search history.

(56) References Cited

U.S. PATENT DOCUMENTS

| | | | | |
|---|---|---|---|---|
| 7,457,698 | B2 | 11/2008 | Danko | |
| 2005/0027420 | A1 | 2/2005 | Fujishima et al. | |
| 2014/0100712 | A1* | 4/2014 | Nomura | E02F 9/264 701/1 |
| 2014/0100744 | A1* | 4/2014 | Johnson | E02F 3/3677 701/50 |

(Continued)

FOREIGN PATENT DOCUMENTS

| | | |
|---|---|---|
| EP | 3712335 | 9/2020 |
| WO | 2019/049701 | 3/2019 |

(Continued)

OTHER PUBLICATIONS

International Search Report for PCT/JP2022/015224 mailed on Jun. 14, 2022.

*Primary Examiner* — Mahmoud S Ismail
(74) *Attorney, Agent, or Firm* — IPUSA, PLLC

(57) ABSTRACT

A shovel includes a lower traveling body, an upper swiveling body mounted to the lower traveling body, attachments including a boom attached to the upper swiveling body, an arm attached to an end of the boom, and a bucket that is an end attachment attached to an end of the arm, and a control device configured to control swiveling of the upper swiveling body and movement of the attachments so that an end portion of the bucket moves along an extension of a slope toe, which is a target line.

11 Claims, 21 Drawing Sheets

(56) References Cited

U.S. PATENT DOCUMENTS

| | | | | |
|---|---|---|---|---|
| 2019/0211530 | A1* | 7/2019 | Kaneta | E02F 9/2271 |
| 2019/0249391 | A1* | 8/2019 | Kikuchi | E02F 3/845 |
| 2020/0199843 | A1 | 6/2020 | Ono | |
| 2020/0291606 | A1 | 9/2020 | Izumikawa et al. | |
| 2021/0010237 | A1* | 1/2021 | Aizawa | E02F 3/439 |
| 2021/0010241 | A1* | 1/2021 | Nishi | E02F 9/2285 |
| 2021/0262196 | A1 | 8/2021 | Ito | |

FOREIGN PATENT DOCUMENTS

| | | |
|---|---|---|
| WO | 2019/112059 | 6/2019 |
| WO | 2019/189935 | 10/2019 |
| WO | 2020/101005 | 5/2020 |

* cited by examiner

SHOVEL AND CONTROL DEVICE FOR SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2022/015224, filed on Mar. 28, 2022 and designating the U.S., which claims priority to Japanese Patent Application No. 2021-060297, filed Mar. 31, 2021 and Japanese Patent Application No. 2021-062318, filed Mar. 31, 2021. The entire contents of the foregoing applications are incorporated herein by reference.

BACKGROUND

Technical Field

The present disclosure relates to shovels and control devices for shovels.

Description of Related Art

Shovels that enable upper swiveling bodies to face a slope straight have been known.

SUMMARY

According to one aspect of the present disclosure, a shovel includes: a lower traveling body; an upper swiveling body mounted to the lower traveling body; attachments including a boom attached to the upper swiveling body, an arm attached to an end of the boom, and an end attachment attached to an end of the arm; and a control device configured to control swiveling of the upper swiveling body and movement of the attachments so that an end portion of the end attachment moves along a target line.

DETAILED DESCRIPTION

Existing shovels do not assist an operation for forming a slope toe that is a lower edge of the slope. Therefore, the operator of the shovel is sometimes unable to efficiently form edge portions of ground features, such as the toe slope that is the lower edge of the slope.

In view thereof, it is desirable to provide a shovel that can assist formation of the edge portions of the ground features.

Figure 1:
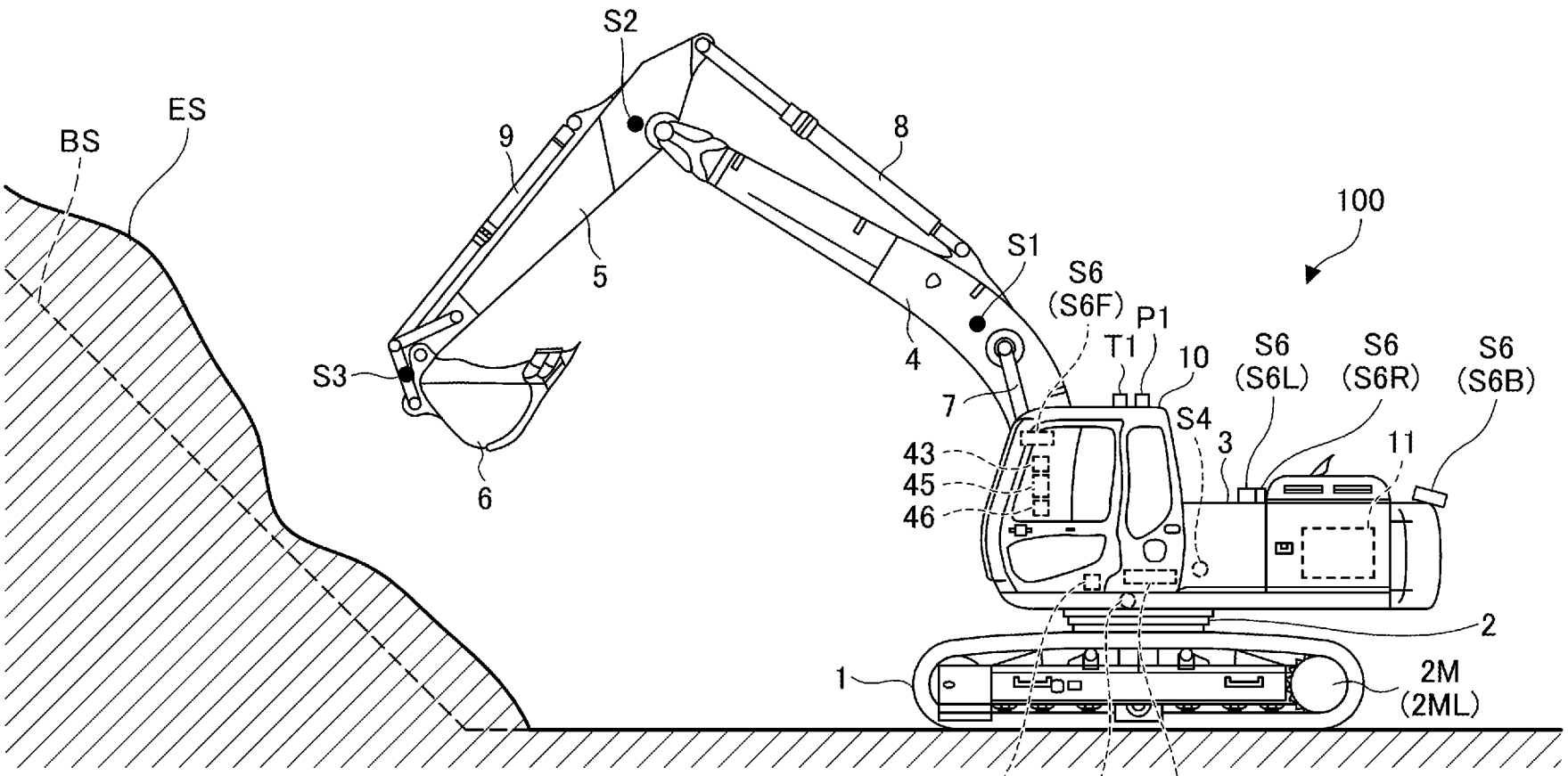
FIG. 1 is a side view of a shovel according to an embodiment of the present disclosure.

FIG. 1 is a side view of a shovel 100, which is an excavator, according to an embodiment of the present disclosure. An upper swiveling body 3 is mounted via a swiveling mechanism 2 to a lower traveling body 1 of the shovel 100. A boom 4 is attached to the upper swiveling body 3. An arm 5 is attached to an end of the boom 4, and a bucket 6, which is an end attachment, is attached to an end of the arm 5. The bucket 6 may be a slope bucket.

The boom 4, the arm 5, and the bucket 6 form an excavating attachment, which is an example of the attachment. The boom 4 is driven by a boom cylinder 7, the arm 5 is driven by an arm cylinder 8, and the bucket 6 is driven by a bucket cylinder 9. A boom angle sensor S1 is attached to the boom 4, an arm angle sensor S2 is attached to the arm 5, and a bucket angle sensor S3 is attached to the bucket 6.

The boom angle sensor S1 is configured to detect a rotation angle of the boom 4. In the present embodiment, the boom angle sensor S1 is an acceleration sensor, and can detect the rotation angle of the boom 4 with respect to the upper swiveling body 3 (hereinafter referred to as a "boom angle"). The boom angle is, for example, the minimum angle when the boom 4 is moved down at the lowest position, and the boom angle increases as the boom 4 is raised.

The arm angle sensor S2 is configured to detect a rotation angle of the arm 5. In the present embodiment, the arm angle sensor S2 is an acceleration sensor, and can detect the rotation angle of the arm 5 with respect to the boom 4 (hereinafter referred to as an "arm angle"). The arm angle is, for example, the minimum angle when the arm 5 is closed at most, and the arm angle increases as the arm 5 is opened.

The bucket angle sensor S3 is configured to detect a rotation angle of the bucket 6. In the present embodiment, the bucket angle sensor S3 is an acceleration sensor, and can detect the rotation angle of the bucket 6 with respect to the arm 5 (hereinafter referred to as a "bucket angle"). The bucket angle is, for example, the minimum angle when the bucket 6 is closed at most, and the bucket angle increases as the bucket 6 is opened.

The boom angle sensor S1, the arm angle sensor S2, and the bucket angle sensor S3 may each be a potentiometer using a variable resistor, a stroke sensor that detects a stroke amount of a corresponding hydraulic cylinder, a rotary encoder that detects the rotation angle about a coupling pin, a gyro sensor, or a combination of an acceleration sensor and a gyro sensor.

A cab 10, which is an operation room, is provided in the upper swiveling body 3 and a power source such as an engine 11 is mounted to the upper swiveling body 3. A controller 30, a sound output device 43, a display device 45, an input device 46, a storage device 47, a machine body tilt sensor S4, a swivel angular velocity sensor S5, a camera S6, a communication device T1, a position measurement device P1, and the like are attached to the upper swiveling body 3.

The controller 30 is configured to function as a main control part for drive control of the shovel 100. In the present embodiment, the controller 30 is formed by a computer including, for example, a CPU, a RAM, and a ROM. Various functions of the controller 30 are achieved by, for example, the CPU executing a program stored in the ROM. The various functions include, for example, a machine guidance function that guides the operator to perform a manual operation of the shovel 100 and a machine control function that automatically assists the operator to perform the manual operation of the shovel 100. A machine control device 50 included in the controller 30 is configured to perform the machine guidance function and the machine control function.

The display device 45 is configured to display various information. The display device 45 may be connected to the controller 30 through a communication network such as CAN or may be connected to the controller 30 through a private network.

The input device 46 is configured to enable the operator to input various information to the controller 30. The input device 46 includes, for example, a touch panel, a knob switch, and a membrane switch that are mounted to the cab 10.

The sound output device 43 is configured to output a sound. The sound output device 43 may be, for example, an on-board speaker connected to the controller 30 or an alarm such as a buzzer. According to the present embodiment, the sound output device 43 is configured to output the sound indicating various information in response to a sound output command from the controller 30.

The storage device 47 is configured to store various information. The storage device 47 is, for example, a non-volatile storage medium, such as a semiconductor memory. The storage device 47 may store information output by various devices during operation of the shovel 100 or may store information obtained through various devices before the operation of the shovel 100 is started. For example, the storage device 47 may store information related to the target construction surface obtained through a communication device T1 or the like. The target construction surface may be set by the operator of the shovel 100 or may be set by a construction manager or the like.

The machine body tilt sensor S4 is configured to detect the tilt of the upper swiveling body 3 with respect to a virtual horizontal plane. In the present embodiment, the machine body tilt sensor S4 is an acceleration sensor that detects the tilting angle about the front-back axis of the upper swiveling body 3 and the tilting angle about the left-right axis of the upper swiveling body 3. The front-back axis and the left-right axis of the upper swiveling body 3 are orthogonal to each other at the center point of the shovel, which is a point on the swiveling axis of the shovel 100, for example.

The swivel angular velocity sensor S5 is configured to detect the swiveling angular velocity of the upper swiveling body 3. The swivel angular velocity sensor S5 may be configured to detect or calculate the swiveling angle of the upper swiveling body 3. In the present embodiment, the swivel angular velocity sensor S5 is a gyro sensor. The swivel angular velocity sensor S5 may be a resolver, a rotary encoder, or the like.

The camera S6 is an example of a space recognition device and is configured to obtain an image around the shovel 100. In the present embodiment, the camera S6 includes a front camera S6F that images a space in front of the shovel 100, a left camera S6L that images a space on the left of the shovel 100, a right camera S6R that images a space on the right of the shovel 100, and a back camera S6B that images a space at the back of the shovel 100.

The camera S6 is, for example, a monocular camera having an imaging element such as a CCD or CMOS, and outputs a taken image to the display device 45. The camera S6 may be a stereo camera, a distance image camera, or the like. Also, the camera S6 may be replaced by another space recognition device, such as an ultrasonic sensor, a millimeter wave radar, a LIDAR sensor, or an infrared sensor, or may be replaced by a combination of another space recognition device and a camera.

The front camera S6F is attached to, for example, the ceiling of the cab 10, that is, inside the cab 10. However, the front camera S6F may be attached to the roof of the cab 10, that is, outside the cab 10. The left camera S6L is attached to a left end of the upper surface of the upper swiveling body 3, the right camera S6R is attached to a right end of the upper surface of the upper swiveling body 3, and the back camera S6B is attached to a back end of the upper surface of the upper swiveling body 3.

The communication device T1 controls communication with an external device outside the shovel 100. In the present embodiment, the communication device T1 controls communication with an external device through a satellite communication network, a cellular phone communication network, the Internet, or the like. The external device may be, for example, a management device such as a server installed in an external facility or an assistant device such as a smartphone carried by a worker around the shovel 100. The external device is, for example, configured to manage construction information about one or more shovels 100. The construction information includes, for example, information related to operation time, fuel consumption, workload, and the like of the shovel 100. The workload is, for example, the amount of excavated earth and sand and the amount of earth and sand loaded onto a dump truck platform. The shovel 100 is configured to send the construction information related to the shovel 100 to the external device through the communication device T1 at predetermined time intervals.

The position measurement device P1 is configured to measure the position of the upper swiveling body 3. The position measurement device P1 may be configured to measure a direction of the upper swiveling body 3. In the present embodiment, the position measurement device P1 is, for example, a GNSS compass. The position measurement device P1 detects the position and the direction of the upper swiveling body 3 and outputs a detected value to the controller 30. Therefore, the position measurement device P1 can function as a direction detecting device that detects the direction of the upper swiveling body 3. The direction detecting device may be a direction sensor attached to the upper swiveling body 3.

Figure 2:
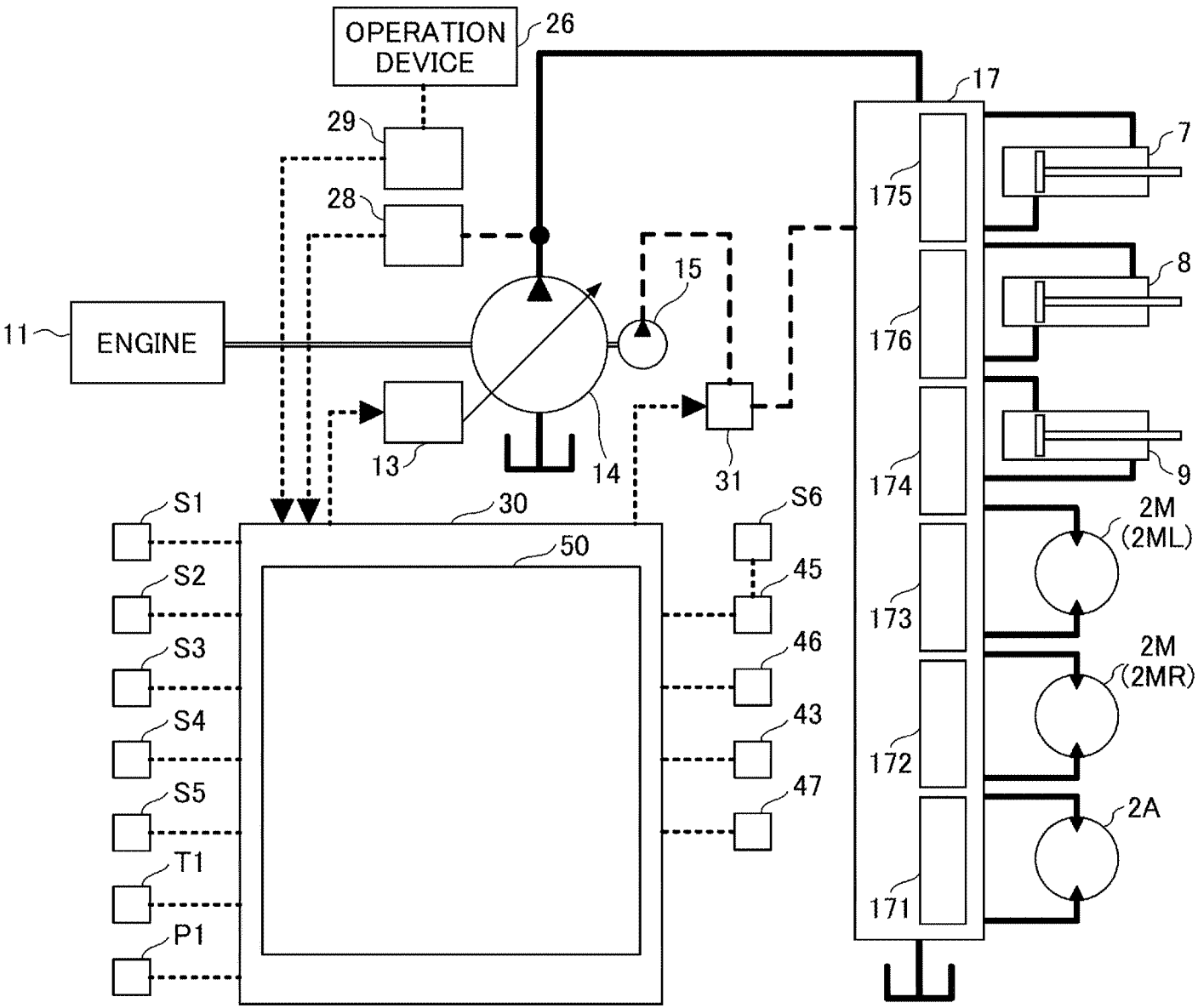
FIG. 2 is a block diagram illustrating a configuration example of a driving system of the shovel of FIG. 1.

FIG. 2 is a block diagram illustrating a configuration example of a driving system of the shovel 100, and a mechanical power system, a hydraulic oil line, a pilot line, and an electric control system are illustrated with a double line, a solid line, a dashed line, and a dotted line, respectively.

The driving system of the shovel 100 mainly includes, for example, the engine 11, a regulator 13, a main pump 14, a pilot pump 15, a control valve unit 17, an operation device 26, a discharge pressure sensor 28, an operation sensor 29, the controller 30, and a proportional valve 31.

The engine 11 is a driving source of the shovel 100. In the present embodiment, the engine 11 is, for example, a diesel engine that is operated to maintain a predetermined rotation speed. Output shafts of the engine 11 are coupled to respective input shafts of the main pump 14 and the pilot pump 15.

The main pump 14 is configured to feed hydraulic oil to the control valve unit 17 through the hydraulic oil line. In the present embodiment, the main pump 14 is a swashplate variable displacement hydraulic pump.

The regulator 13 is configured to control the discharge amount of the main pump 14. In the present embodiment, the regulator 13 controls the discharge amount of the main pump 14 by adjusting the swashplate tilting angle of the main pump 14 in response to a control command from the controller 30. For example, the controller 30 receives an output of the operation sensor 29 or the like, and outputs a control command to the regulator 13 as needed to change the discharge amount of the main pump 14.

The pilot pump 15 feeds the hydraulic oil through the pilot line to various hydraulic control devices, including the proportional valve 31. In the present embodiment, the pilot pump 15 is a fixed displacement hydraulic pump. However, the pilot pump 15 may be omitted. In this case, the function performed by the pilot pump 15 may be achieved by the main pump 14. That is, the main pump 14 may be provided with a circuit other than a function of feeding the hydraulic oil to the control valve unit 17, and may have a function of feeding the hydraulic oil to the proportional valve 31 or the like after the feed pressure of the hydraulic oil is lowered by restriction or the like.

The control valve unit 17 is a hydraulic control device that controls a hydraulic system in the shovel 100. In the present embodiment, the control valve unit 17 includes control valves 171 to 176. The control valve unit 17 may selectively feed the hydraulic oil discharged by the main pump 14 to one or more hydraulic actuators through the control valves 171 to 176. The control valves 171 to 176 are configured to control the flow rate of the hydraulic oil flowing from the main pump 14 to the hydraulic actuator and the flow rate of the hydraulic oil flowing from the hydraulic actuator to a hydraulic oil tank. The hydraulic actuator includes the boom cylinder 7, the arm cylinder 8, the bucket cylinder 9, a traveling hydraulic motor 2M, and a swiveling hydraulic motor 2A, which is a swiveling actuator. The traveling hydraulic motor 2M includes a left-side traveling hydraulic motor 2ML and a right-side traveling hydraulic motor 2MR. The swiveling hydraulic motor 2A may be a swiveling electric-powered electric generating device as an electric-powered swiveling actuator.

The operation device 26 is a device used by an operator for operating the actuator. The actuator includes the hydraulic actuator, the electric-powered actuator, or both.

The discharge pressure sensor 28 is configured to detect the discharge pressure of the main pump 14. In the present embodiment, the discharge pressure sensor 28 outputs a detected value to the controller 30.

The operation sensor 29 is configured to detect an operation content of the operator using the operation device 26. In the present embodiment, the operation sensor 29 detects the direction and the amount of the operation of the operation device 26 corresponding to each of the actuators, and outputs a detected value to the controller 30. In the present embodiment, the controller 30 controls an opening area of the proportional valve 31 in accordance with the output of the operation sensor 29. The controller 30 feeds the hydraulic oil discharged by the pilot pump 15 to pilot ports of corresponding control valves in the control valve unit 17. The pressure (pilot pressure) of the hydraulic oil fed to each of the pilot ports is, in principle, a pressure in accordance with the direction and the amount of the operation of the operation device 26 corresponding to each of the hydraulic actuators. In this way, the operation device 26 is configured to feed the hydraulic oil discharged by the pilot pump 15 to the pilot ports of the corresponding control valves in the control valve unit 17.

The proportional valve 31, which functions as a machine control valve, is disposed in a conduit connecting the pilot pump 15 to the pilot port of the control valve in the control valve unit 17 and is configured to change the flow area of the conduit. In the present embodiment, the proportional valve 31 operates in response to a control command output by the controller 30. Thus, the controller 30 can feed the hydraulic oil discharged by the pilot pump 15 to the pilot port of the control valve in the control valve unit 17 through the proportional valve 31, independently of the operation of the operation device 26 by the operator.

With this configuration, even if no operation is being performed on a specific operation device 26, the controller 30 can operate the hydraulic actuator corresponding to the specific operation device 26.

Next, the machine control device 50 included in the controller 30 will be described. The machine control device 50 is configured to perform, for example, a machine guidance function. In the present embodiment, the machine control device 50 communicates work information to the operator, such as the distance between the target construction surface and a working portion of the attachment. Information related to the target construction surface is stored in the storage device 47 in advance, for example. The machine control device 50 may obtain the information related to the target construction surface from the external device through the communication device T1. The information related to the target construction surface is, for example, expressed in a reference coordinate system. The reference coordinate system is, for example, the world geodetic system. The world geodetic system is a three-dimensional orthogonal XYZ coordinate system in which the origin is set at the center of gravity of the globe, the X axis is taken in a direction toward the intersection between the Greenwich meridian and the equator, the Y axis is taken in a direction at 90 degrees of the east longitude, and the Z axis is taken in a direction toward the North Pole. The target construction surface may be set based on a relative positional relationship to a reference point. In this case, the operator may define a given point of the construction site as the reference point. The working portion of the attachment is, for example, the tip end (toe) of the bucket 6 or the back surface of the bucket 6. The machine control device 50 may be configured to guide the operation of the shovel 100 by communicating operation information to the operator through, for example, the display device 45 or the sound output device 43.

The machine control device 50 may perform a machine control function that automatically assists the manual operation of the shovel 100 performed by the operator. For example, the machine control device 50 may automatically operate the boom 4, the arm 5, the bucket 6, or any combination thereof so that the target construction surface coincides with the position of the tip of the bucket 6 when the operator manually performs an excavating operation.

In the present embodiment, the machine control device 50 is incorporated into the controller 30, but may be a control device separately provided from the controller 30. In this case, the machine control device 50 is, for example, formed by a computer including, a CPU and an internal memory, in a manner similar to the controller 30. The various functions of the machine control device 50 are achieved by the CPU executing a program stored in the internal memory. The machine guidance device 50 and the controller 30 are communicably connected to each other through a communication network such as CAN.

Figure 3:
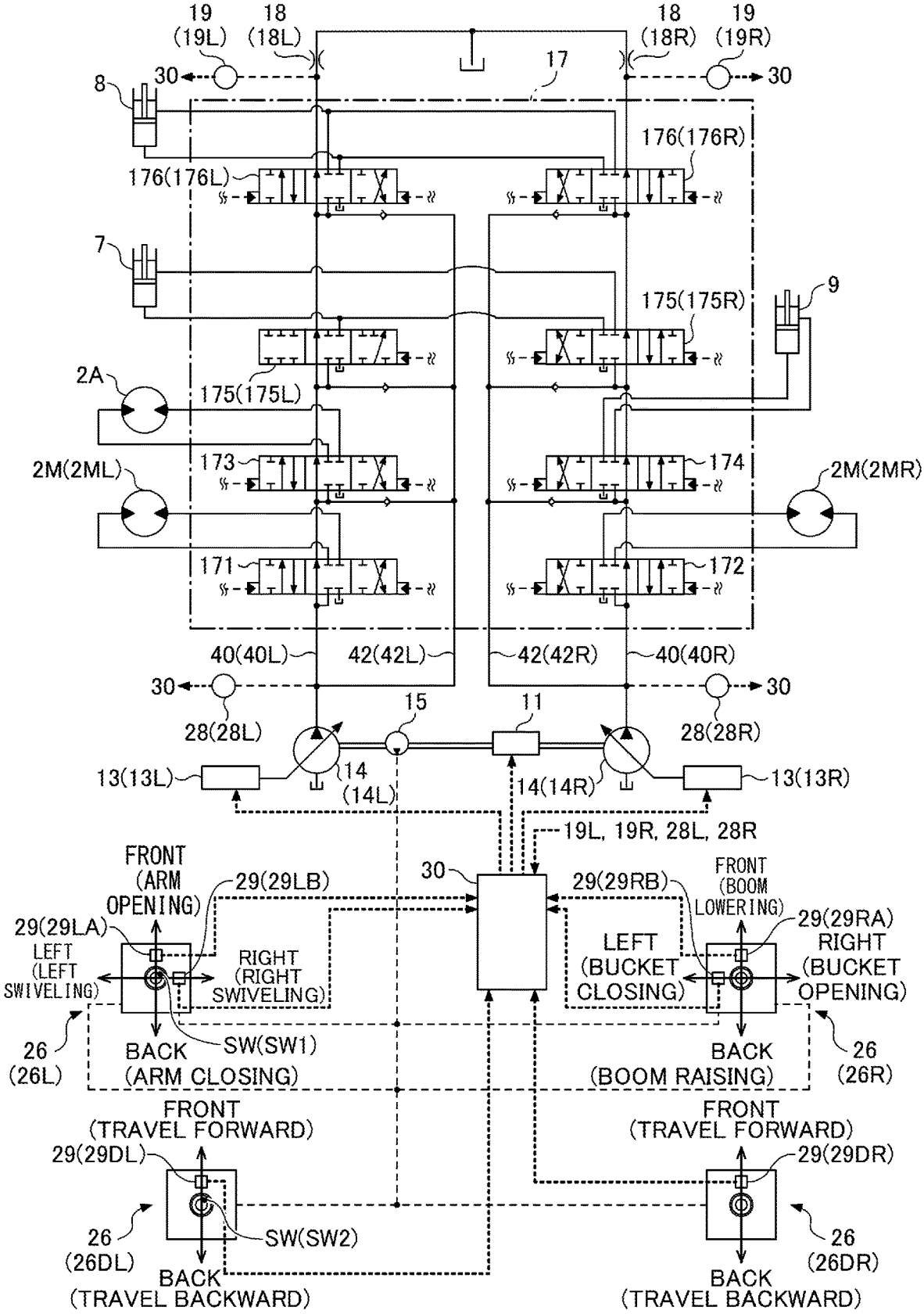
FIG. 3 is a schematic view illustrating a configuration example of a hydraulic system mounted to the shovel of FIG. 1.

Next, a configuration example of the hydraulic system mounted to the shovel 100 will be described with reference to FIG. 3. FIG. 3 is a view illustrating a configuration example of the hydraulic system mounted to the shovel 100. In FIG. 3, the mechanical power system, the hydraulic oil line, the pilot line, and the electric control system are illustrated with a double line, a solid line, a dashed line, and a dotted line, respectively.

The hydraulic system of the shovel 100 mainly includes, for example, the engine 11, a regulator 13, a main pump 14, a pilot pump 15, a control valve unit 17, an operation device 26, a discharge pressure sensor 28, an operation sensor 29, and the controller 30.

In FIG. 3, the hydraulic system is configured to circulate the hydraulic oil from the main pump 14 driven by the engine 11 to the hydraulic oil tank through a center bypass conduit 40 or a parallel conduit 42.

The engine 11 is a driving source of the shovel 100. In the present embodiment, the engine 11 is, for example, a diesel engine that is operated to maintain a predetermined rotation speed. Output shafts of the engine 11 are coupled to respective input shafts of the main pump 14 and the pilot pump 15.

The main pump 14 is configured to feed the hydraulic oil to the control valve unit 17 through the hydraulic oil line. In the present embodiment, the main pump 14 is a swashplate variable displacement hydraulic pump.

The regulator 13 is configured to control the discharge amount of the main pump 14. In the present embodiment, the regulator 13 controls the discharge amount of the main pump 14 by adjusting the swashplate tilting angle of the main pump 14 in response to a control command from the controller 30.

The pilot pump 15 is one example of a pilot pressure generating device, and is configured to feed the hydraulic oil to a hydraulic pressure control device through the pilot line. In the present embodiment, the pilot pump 15 is a fixed displacement hydraulic pump. However, the pilot pressure generating device may be achieved by the main pump 14. That is, the main pump 14 may have a function of feeding the hydraulic oil to various hydraulic control devices through the pilot line, in addition to the function of feeding the hydraulic oil to the control valve unit 17 through the hydraulic oil line. In this case, the pilot pump 15 may be omitted.

The control valve unit 17 is a hydraulic control device that controls the hydraulic system in the shovel 100. In the present embodiment, the control valve unit 17 includes control valves 171 to 176. The control valve 175 includes a control valve 175L and a control valve 175R, and the control valve 176 includes a control valve 176L and a control valve 176R. The control valve unit 17 is configured to selectively feed the hydraulic oil discharged by the main pump 14 to one or more hydraulic actuators through the control valves 171 to 176. The control valves 171 to 176 control, for example, the flow rate of the hydraulic oil flowing from the main pump 14 to the hydraulic actuator and the flow rate of the hydraulic oil flowing from the hydraulic actuator to the hydraulic oil tank. The hydraulic actuator includes the boom cylinder 7, the arm cylinder 8, the bucket cylinder 9, the traveling hydraulic motor 2M, and the swiveling hydraulic motor 2A. The traveling hydraulic motor 2M includes the left-side traveling hydraulic motor 2ML and the right-side traveling hydraulic motor 2MR.

The operation device 26 is configured so that the operator can operate the actuator. In the present embodiment, the operation device 26 includes a hydraulic actuator operation device configured so that the operator can operate the hydraulic actuator. Specifically, the hydraulic actuator operation device is configured to feed, through the pilot line, the hydraulic oil discharged by the pilot pump 15 to the pilot port of the corresponding control valve in the control valve unit 17. The pressure (pilot pressure) of the hydraulic oil fed to each of the pilot ports is a pressure in accordance with the direction and the amount of the operation of the operation device 26 corresponding to each of the hydraulic actuators.

The discharge pressure sensor 28 is configured to detect the discharge pressure of the main pump 14. In the present embodiment, the discharge pressure sensor 28 outputs a detected value to the controller 30.

The operation sensor 29 is configured to detect an operation content of the operator using the operation device 26. In the present embodiment, the operation sensor 29 detects the direction and the amount of the operation of the operation device 26 corresponding to each of the actuators, and outputs a detected value to the controller 30.

The main pump 14 includes a left main pump 14L and a right main pump 14R. The left main pump 14L circulates the hydraulic oil to the hydraulic oil tank through a left center bypass conduit 40L or a left parallel conduit 42L, and the right main pump 14R circulates the hydraulic oil to the hydraulic oil tank through a right center bypass conduit 40R or a right parallel conduit 42R.

The left center bypass conduit 40L is a hydraulic oil line passing through the control valves 171, 173, 175L, and 176L disposed in the control valve unit 17. The right center bypass conduit 40R is a hydraulic oil line passing through the control valves 172, 174, 175R, and 176R disposed in the control valve unit 17.

The control valve 171 is a spool valve that feeds the hydraulic oil discharged by the left main pump 14L to the left-side traveling hydraulic motor 2ML, and switches the flow of the hydraulic oil for discharging the hydraulic oil discharged by the left-side traveling hydraulic motor 2ML to the hydraulic oil tank.

The control valve 172 is a spool valve that feeds the hydraulic oil discharged by the right main pump 14R to the right-side traveling hydraulic motor 2MR, and switches the flow of the hydraulic oil for discharging the hydraulic oil discharged by the right-side traveling hydraulic motor 2MR to the hydraulic oil tank.

The control valve 173 is a spool valve that feeds the hydraulic oil discharged by the left main pump 14L to the swiveling hydraulic motor 2A, and switches the flow of the hydraulic oil for discharging the hydraulic oil discharged by the swiveling hydraulic motor 2A to the hydraulic oil tank.

The control valve 174 is a spool valve that feeds the hydraulic oil discharged by the right main pump 14R to the bucket cylinder 9, and switches the flow of the hydraulic oil for discharging the hydraulic oil in the bucket cylinder 9 to the hydraulic oil tank.

The control valve 175L is a spool valve that switches the flow of the hydraulic oil for feeding the hydraulic oil discharged by the left main pump 14L to the boom cylinder 7. The control valve 175R is a spool valve that feeds the hydraulic oil discharged by the right main pump 14R to the boom cylinder 7, and switches the flow of the hydraulic oil for discharging the hydraulic oil in the boom cylinder 7 to the hydraulic oil tank.

The control valve 176L is a spool valve that feeds the hydraulic oil discharged by the left main pump 14L to the arm cylinder 8, and switches the flow of the hydraulic oil for discharging the hydraulic oil in the arm cylinder 8 to the hydraulic oil tank.

The control valve 176R is a spool valve that feeds the hydraulic oil discharged by the right main pump 14R to the arm cylinder 8, and switches the flow of the hydraulic oil for discharging the hydraulic oil in the arm cylinder 8 to the hydraulic oil tank.

The left parallel conduit 42L is a hydraulic oil line parallel to the left center bypass conduit 40L. The left parallel conduit 42L can feed the hydraulic oil to a downstream control valve when the flow of the hydraulic oil passing through the left center bypass conduit 40L is restricted or blocked by the control valve 171, 173, or 175L. The right parallel conduit 42R is a hydraulic oil line parallel to the right center bypass conduit 40R. The right parallel conduit 42R can feed the hydraulic oil to a downstream control valve when the flow of the hydraulic oil passing through the right center bypass conduit 40R is restricted or blocked by the control valve 172, 174, or 175R.

The regulator 13 includes a left regulator 13L and a right regulator 13R. The left regulator 13L controls the discharge amount of the left main pump 14L by adjusting the swashplate tilting angle of the left main pump 14L in accordance with the discharge pressure of the left main pump 14L. Specifically, the left regulator 13L, for example, adjusts the swashplate tilting angle of the left main pump 14L in accordance with an increase in the discharge pressure of the left main pump 14L to reduce the discharge amount. The same applies to the right regulator 13R. This is to prevent absorption power (absorption horsepower) of the main pump 14, which is represented as a product of the discharge pressure and the discharge amount, from exceeding output power (output horsepower) of the engine 11.

The operation device 26 includes a left operation lever 26L, a right operation lever 26R, and a traveling lever 26D. The traveling lever 26D includes a left traveling lever 26DL and a right traveling lever 26DR.

The left operation lever 26L is used for the swivel operation and the operation of the arm 5. The left operation lever 26L, when operated in the forward and backward directions, utilizes the hydraulic oil discharged by the pilot pump 15 to introduce a control pressure in accordance with the amount of the lever operation into the pilot port of the control valve 176. When operated in the leftward and rightward directions, the hydraulic oil discharged by the pilot pump 15 is used to introduce the control pressure in accordance with the amount of the lever operation into the pilot port of the control valve 173.

Specifically, the left operation lever 26L introduces the hydraulic oil to the right pilot port of the control valve 176L and introduces the hydraulic oil to the left pilot port of the control valve 176R when operated in an arm closing direction. The left operation lever 26L, when operated in an arm opening direction, introduces the hydraulic oil to the left pilot port of the control valve 176L and introduces the hydraulic oil to the right pilot port of the control valve 176R. The left operation lever 26L introduces the hydraulic oil to the left pilot port of the control valve 173 when operated in a leftward swiveling direction and introduces the hydraulic oil to the right pilot port of the control valve 173 when operated in a rightward swiveling direction.

The right operation lever 26R is used to operate the boom 4 and the bucket 6. The right operation lever 26R utilizes the hydraulic oil discharged by the pilot pump 15 when operated in the forward and backward directions to introduce a control pressure in accordance with the amount of the lever operation into the pilot port of the control valve 175. When operated in the leftward and rightward directions, the hydraulic oil discharged by the pilot pump 15 is used to introduce the control pressure in accordance with the amount of the lever operation into the pilot port of the control valve 174.

Specifically, the right operation lever 26R introduces the hydraulic oil to the left pilot port of the control valve 175R when operated in the boom lowering direction. The right operation lever 26R, when operated in the boom raising direction, introduces the hydraulic oil to the right pilot port of the control valve 175L and introduces the hydraulic oil to the left pilot port of the control valve 175R. The right operation lever 26R introduces the hydraulic oil to the right pilot port of the control valve 174 when operated in the bucket closing direction, and introduces the hydraulic oil to the left pilot port of the control valve 174 when operated in the bucket opening direction.

In the following, the left operation lever 26L operated in the leftward and rightward directions may be referred to as a "swivel operation lever" and the left operation lever 26L operated in the forward and backward directions may be referred to as an "arm operation lever". The right operation lever 26R operated in the leftward and rightward directions may be referred to as a "bucket operation lever" and the right operation lever 26R operated in the forward and backward directions may be referred to as a "boom operation lever".

The traveling lever 26D is used to operate a crawler 1C. Specifically, the left traveling lever 26DL is used to operate a left crawler 1CL. It may be configured to interlock with the left traveling pedal. The left traveling lever 26DL, when operated in the forward and backward directions, utilizes the hydraulic oil discharged by the pilot pump 15 to introduce the control pressure in accordance with the amount of the lever operation into the pilot port of the control valve 171. The right traveling lever 26DR is used to operate a right crawler 1CR. It may be configured to interlock with the right traveling pedal. The right traveling lever 26DR, when operated in the forward and backward directions, utilizes the hydraulic oil discharged by the pilot pump 15 to introduce the control pressure in accordance with the amount of the lever operation into the pilot port of the control valve 172.

The discharge pressure sensor 28 includes a discharge pressure sensor 28L and a discharge pressure sensor 28R. The discharge pressure sensor 28L detects the discharge pressure of the left main pump 14L and outputs a detected value to the controller 30. The same applies to the discharge pressure sensor 28R.

The operation sensor 29 includes operation sensors 29LA, 29LB, 29RA, 29RB, 29DL, and 29DR. The operation sensor 291A detects the content of the operation in the forward and backward directions by the operator relative to the left operation lever 26L and outputs a detected value to the controller 30. The content of the operation is, for example, the direction of the lever operation and the amount of the lever operation (angle of the lever operation).

Similarly, the operation sensor 29LB detects the content of the operation by the operator in the leftward and rightward directions relative to the left operation lever 26L and outputs a detected value to the controller 30. The operation sensor 29RA detects the content of the operation by the operator in the forward and backward directions relative to the right operation lever 26R and outputs a detected value to the controller 30. The operation sensor 29RB detects the content of the operation by the operator in the leftward and rightward directions relative to the right operation lever 26R and outputs a detected value to the controller 30. The operation sensor 29DL detects the content of the operation by the operator in the forward and backward directions relative to the left traveling lever 26DL and outputs a detected value to the controller 30. The operation sensor 29DR detects the content of the operation by the operator in the forward and backward directions relative to the right traveling lever 26DR and outputs a detected value to the controller 30.

The controller 30 receives the output of the operation sensor 29 and outputs a control command to the regulator 13 as needed to change the discharge amount of the main pump 14. The controller 30 receives an output of a control pressure sensor 19 disposed upstream of a restrictor 18, and outputs a control command to the regulator 13 as needed to change the discharge amount of the main pump 14. The restrictor 18 includes a left restrictor 18L and a right restrictor 18R, and the control pressure sensor 19 includes a left control pressure sensor 19L and a right control pressure sensor 19R.

In the left center bypass conduit 40L, the left restrictor 18L is disposed between the control valve 176L, which is located the most downstream, and the hydraulic oil tank. Therefore, the flow of hydraulic oil discharged by the left main pump 14L is limited by the left restrictor 18L. The left restrictor 18L generates a control pressure for controlling the left regulator 13L. The left control pressure sensor 19L is a sensor for detecting this control pressure and outputs a detected value to the controller 30. The controller 30 controls the discharge amount of the left main pump 14L by adjusting the tilting angle of the swashplate of the left main pump 14L in accordance with the control pressure. The controller 30 decreases the discharge amount of the left main pump 14L as the control pressure increases, and increases the discharge amount of the left main pump 14L as the control pressure decreases. The discharge amount of the right main pump 14R is controlled in the same manner.

Specifically, when none of the hydraulic actuators of the shovel 100 is in the standby state as illustrated in FIG. 3, the hydraulic oil discharged by the left main pump 14L passes through the left center bypass conduit 40L and reaches the left restrictor 18L. The flow of the hydraulic oil discharged by the left main pump 14L increases the control pressure generated upstream of the left restrictor 18L. As a result, the controller 30 reduces the discharge amount from the left main pump 14L to the allowable minimum discharge amount and suppresses the pressure loss (pumping loss) when the discharged hydraulic oil passes through the left center bypass conduit 40L. On the other hand, when any of the hydraulic actuators is operated, the hydraulic oil discharged by the left main pump 14L flows into the hydraulic actuator to be operated through a control valve corresponding to the hydraulic actuator to be operated. The flow of the hydraulic oil discharged by the left main pump 14L decreases or extinguishes the amount reaching the left restrictor 18L, thereby reducing the control pressure generated upstream of the left restrictor 18L. As a result, the controller 30 increases the discharge rate of the left main pump 14L to circulate sufficient hydraulic oil in the hydraulic actuator to be operated to ensure drive of the hydraulic actuator to be operated. The controller 30 controls the discharge amount of the right main pump 14R in the same manner.

With the above-described configuration, the hydraulic system of FIG. 3 can reduce wasteful energy consumption at the main pump 14 in standby conditions. The wasteful energy consumption includes pumping losses caused by the hydraulic oil discharged by the main pump 14 in the center bypass conduit 40. The hydraulic system of FIG. 3 ensures that when the hydraulic actuator is operated, sufficient hydraulic fluid is fed from the main pump 14 to the hydraulic actuator to be actuated.

Figure 4A:
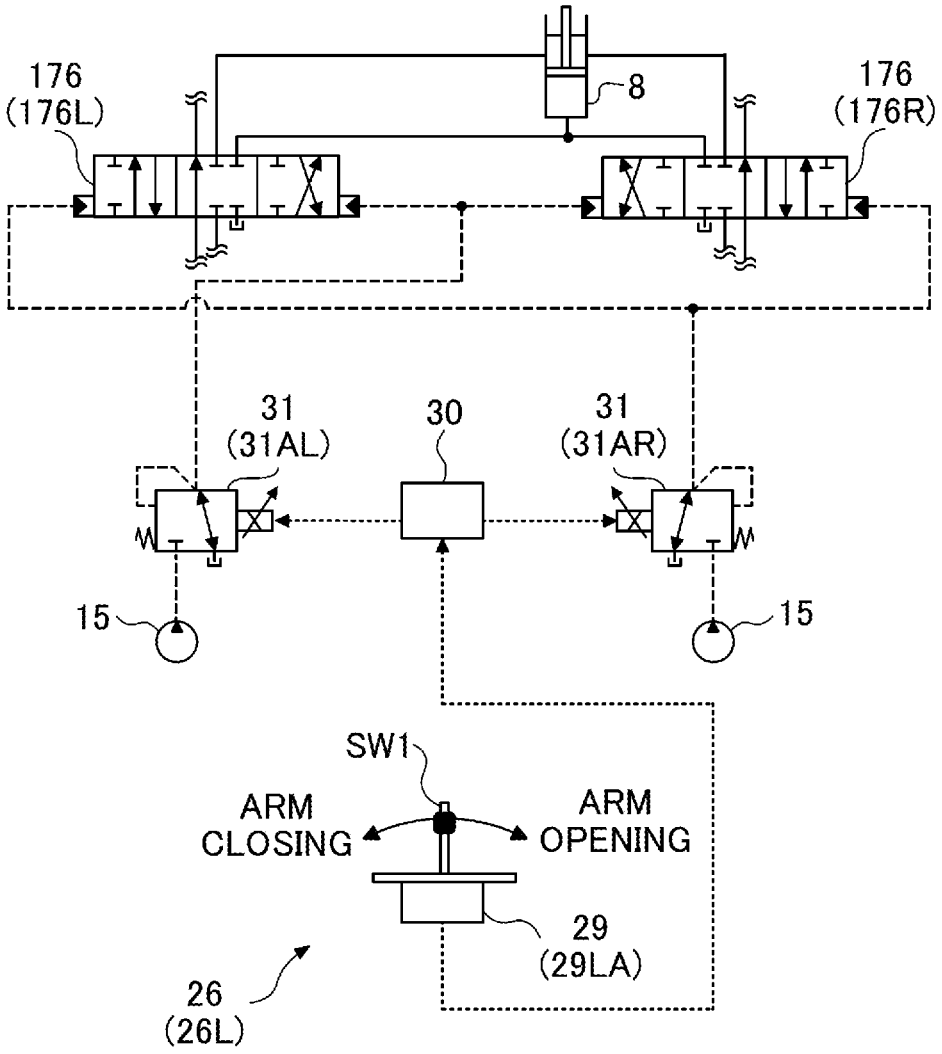
FIG. 4A is a view of a part of a hydraulic system in relation to operation of an arm cylinder.
Figure 4B:
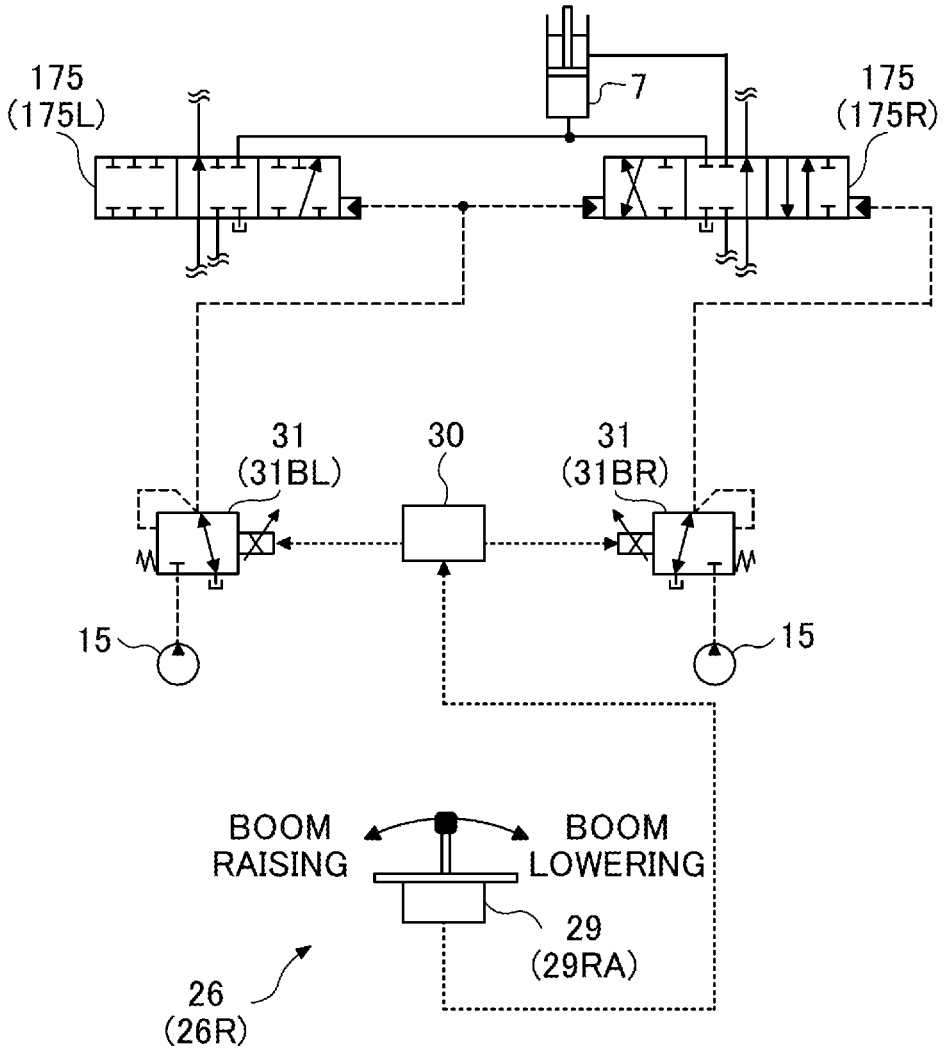
FIG. 4B is a view of a part of a hydraulic system in relation to operation of a boom cylinder.
Figure 4C:
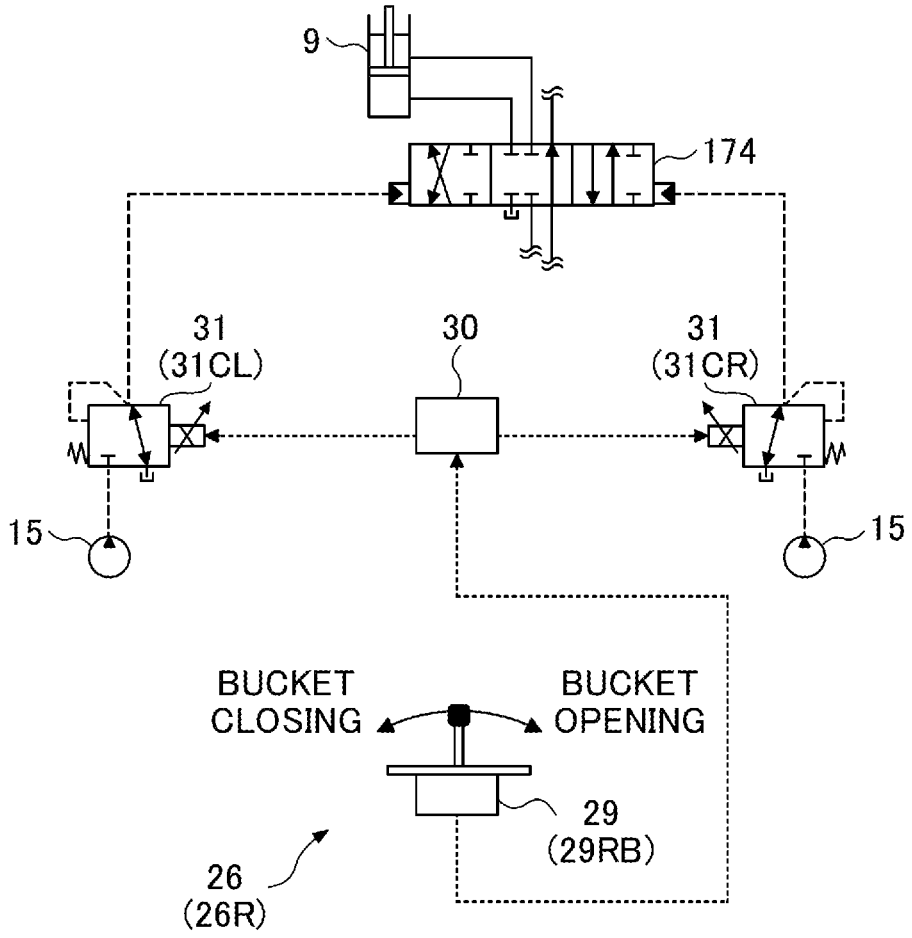
FIG. 4C is a view of a part of a hydraulic system in relation to operation of a bucket cylinder.
Figure 4D:
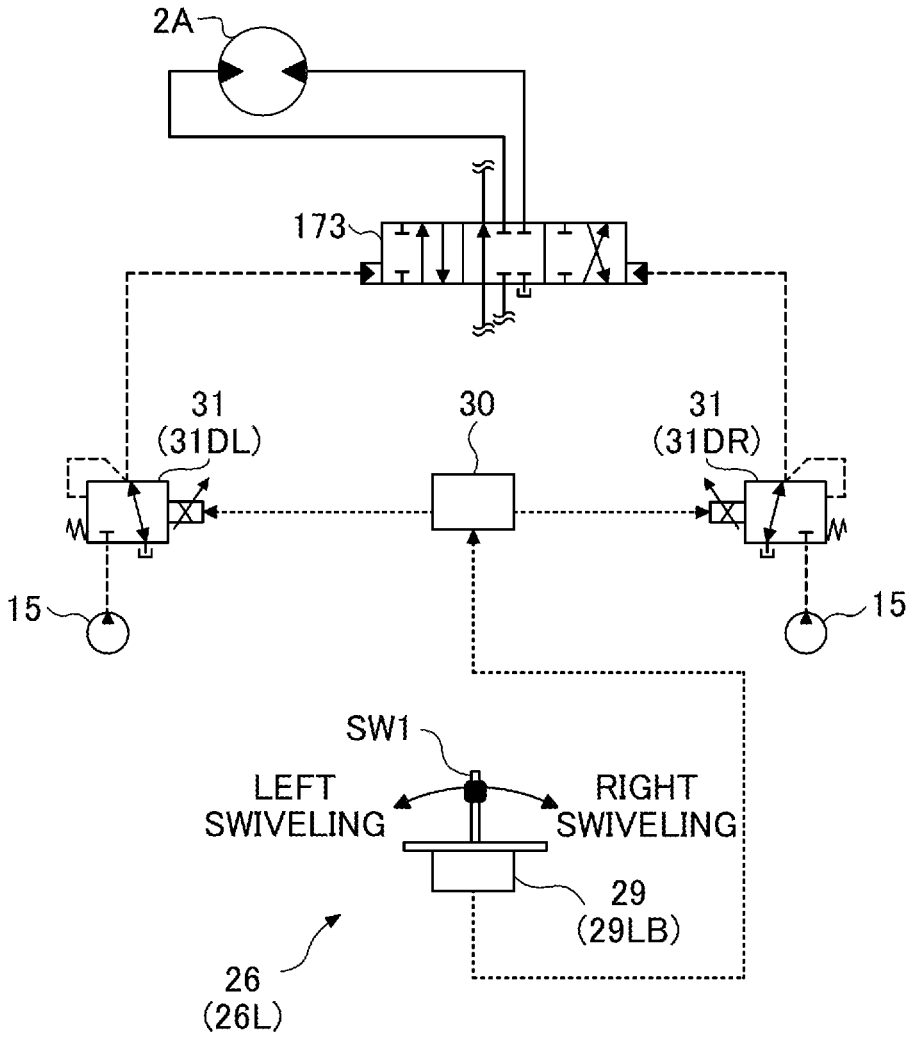
FIG. 4D is a view of a part of a hydraulic system in relation to operation of a swiveling hydraulic motor.
Figure 5A:
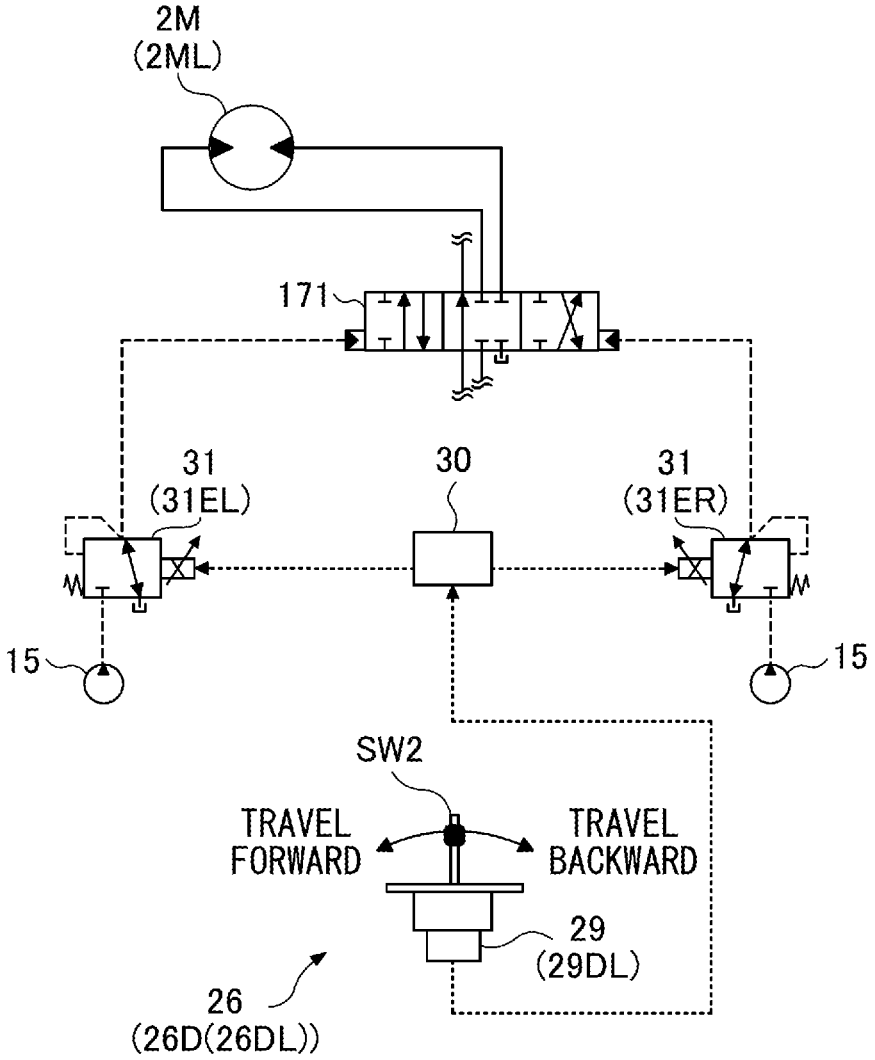
FIG. 5A is a view of a part of a hydraulic system in relation to operation of a left traveling hydraulic motor.
Figure 5B:
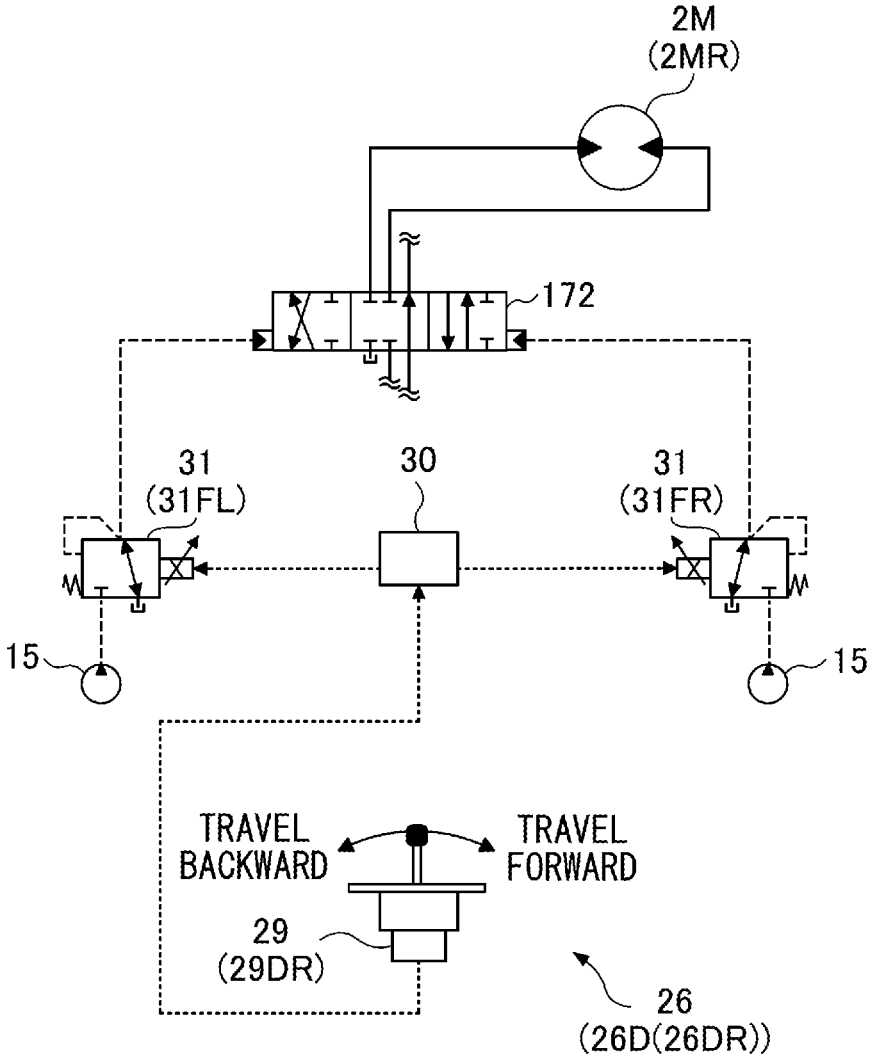
FIG. 5B is a view of a part of a hydraulic system in relation to operation of a right traveling hydraulic motor.

Next, referring to FIG. 4A to FIG. 4D, FIG. 5A, and FIG. 5B, a configuration for the controller 30 to operate the actuators by machine control functions will be described. FIG. 4A to FIG. 4D, FIG. 5A, and FIG. 5B are views of parts extracted from the hydraulic system. Specifically, FIG. 4A is a view of a part extracted from the hydraulic system in relation to the operation of the arm cylinder 8. FIG. 4B is a view of a part extracted from the hydraulic system in relation to the operation of the boom cylinder 7. FIG. 4C is a view of a part extracted from the hydraulic system in relation to the operation of the bucket cylinder 9. FIG. 4D is a view of a part extracted from the hydraulic system in relation to the operation of the swiveling hydraulic motor 2A. FIG. 5A is a view of a part extracted from the hydraulic system in relation to the operation of the left-side traveling hydraulic motor 2ML. FIG. 5B is a view of a part extracted from the hydraulic system in relation to the operation of the right-side traveling hydraulic motor 2MR.

As illustrated in FIG. 4A to FIG. 4D, FIG. 5A, and FIG. 5B, the hydraulic system includes the proportional valve 31. The proportional valve 31 includes proportional valves 31AL to 31DL and 31AR to 31DR.

The proportional valve 31 functions as a control valve for machine control. The proportional valve 31 is disposed in a conduit connecting the pilot pump 15 to the pilot port of the corresponding control valve in the control valve unit 17, and is configured to change the flow path area of the conduit. In the present embodiment, the proportional valve 31 operates in response to a control command output by the controller 30. Thus, the controller 30 can feed the hydraulic oil discharged by the pilot pump 15 to the pilot port of the corresponding control valve in the control valve unit 17 through the proportional valve 31, independently of the operation of the operation device 26 by the operator. The controller 30 can apply a pilot pressure generated by the proportional valve 31 to the pilot port of the corresponding control valve.

With this configuration, even if no operation is being performed on a specific operation device 26, the controller 30 can operate the hydraulic actuator corresponding to the specific operation device 26. Also, even if an operation is being performed on the specific operation device 26, the controller 30 can forcibly stop the operation of the hydraulic actuator corresponding to the specific operation device 26.

For example, as illustrated in FIG. 4A, the left operation lever 26L is used to operate the arm 5. Specifically, the left operation lever 26L utilizes the hydraulic oil discharged by the pilot pump 15 to apply a pilot pressure to the pilot port of the control valve 176 in response to the operation in the forward and backward directions. More specifically, the left operation lever 26L, when operated in the arm closing direction (backward direction), applies a pilot pressure in accordance with the operation amount to the right pilot port of the control valve 176L and the left pilot port of the control valve 176R. The left operation lever 26L, when operated in the arm opening direction (forward direction), applies a pilot pressure in accordance with the operation amount to the left pilot port of the control valve 176L and the right pilot port of the control valve 176R.

The operation device 26 is provided with a switch SW. In the present embodiment, the switch SW includes a switch SW1 and a switch SW2. The switch SW1 is a push-button switch provided at the end of the left operation lever 26L. The operator can operate the left operation lever 26L while pressing the switch SW1. The switch SW1 may be provided at the right operation lever 26R or at other locations within the cab 10. The switch SW2 is a push-button switch provided at the end of the left traveling lever 26DL. The operator can operate the left traveling lever 26DL while pressing the switch SW2. The switch SW2 may be provided at the right traveling lever 26DR or at other locations within the cab 10.

The operation sensor 291A detects the content of the operation in the forward and backward directions by the operator relative to the left operation lever 26L and outputs a detected value to the controller 30.

The proportional valve 31AL operates in response to a control command (electric current command) output by the controller 30, thereby adjusting the pilot pressure of the hydraulic oil introduced from the pilot pump 15 to the right pilot port of the control valve 176L and the left pilot port of the control valve 176R through the proportional valve 31AL. The proportional valve 31AR operates in response to a control command (electric current command) output by the controller 30, thereby adjusting the pilot pressure of the hydraulic oil introduced from the pilot pump 15 to the left pilot port of the control valve 176L and the right pilot port of the control valve 176R through the proportional valve 31AR. The proportional valve 31AL can adjust the pilot pressure so that the control valve 176L and the control valve 176R can be stopped at a given valve position. Similarly, the proportional valve 31AR can adjust the pilot pressure so that the control valve 176L and the control valve 176R can be stopped at a given valve position.

With this configuration, the controller 30 can feed the hydraulic oil discharged by the pilot pump 15 to the right pilot port of the control valve 176L and the left pilot port of the control valve 176R through the proportional valve 31AL in response to the arm closing operation by the operator. Also, the controller 30 can feed the hydraulic oil discharged by the pilot pump 15 to the right pilot port of the control valve 176L and the left pilot port of the control valve 176R through the proportional valve 31AL independently of the arm closing operation by the operator. That is, the controller 30 can close the arm 5 in response to the arm closing operation by the operator or independently of the arm closing operation by the operator.

Also, the controller 30 can feed the hydraulic oil discharged by the pilot pump 15 to the left pilot port of the control valve 176L and the right pilot port of the control valve 176R through the proportional valve 31AR in response to the arm opening operation by the operator. Also, the controller 30 can feed the hydraulic oil discharged by the pilot pump 15 to the left pilot port of the control valve 176L and the right pilot port of the control valve 176R through the proportional valve 31AR independently of the arm opening operation by the operator. That is, the controller 30 can open the arm 5 in response to the arm opening operation by the operator or independently of the arm opening operation by the operator.

With this configuration, even if the arm closing operation is being performed by the operator, the controller 30, as needed, can reduce the pilot pressure applied to the pilot port on the closing side of the control valve 176 (the left pilot port of the control valve 176L and the right pilot port of the control valve 176R) and forcibly stop the closing movement of the arm 5. The same applies to the case of forcibly stopping the opening movement of the arm 5 when the arm opening operation is performed by the operator.

Alternatively, even if the arm closing operation is being performed by the operator, the controller 30, as needed, may forcibly stop the closing movement of the arm 5 by controlling the proportional valve 31AR to increase the pilot pressure applied to the pilot port on the opening side of the control valve 176, which is located opposite to the pilot port on the closing side of the control valve 176, (the right pilot port of the control valve 176L and the left pilot port of the control valve 176R), thereby forcibly returning the control valve 176 to a neutral position. The same applies to the case of forcibly stopping the opening movement of the arm 5 when the arm opening operation is performed by the operator.

Although description with reference to FIG. 4B to FIG. 4D, FIG. 5A, and FIG. 5B is omitted in the following, the same applies to: the case of forcibly stopping the movement of the boom 4 when a boom raising operation or a boom lowering operation is being performed by the operator; the case of forcibly stopping the movement of the bucket 6 when a bucket closing operation or a bucket opening operation is being performed by the operator; and the case of forcibly stopping the swiveling movement of the upper swiveling body 3 when a swiveling operation is being performed by the operator. Also, the same applies to the case of forcibly stopping a traveling movement of the lower traveling body 1 when a traveling operation is being performed by the operator.

Also, as illustrated in FIG. 4B, the right operation lever 26R is used to operate the boom 4. Specifically, the right operation lever 26R utilizes the hydraulic oil discharged by the pilot pump 15 to apply a pilot pressure to the pilot port of the control valve 175 in response to the operation in the forward and backward directions. More specifically, the right operation lever 26R, when operated in a boom raising direction (backward direction), applies a pilot pressure in accordance with the operation amount to the right pilot port of the control valve 175L and the left pilot port of the control valve 175R. The right operation lever 26R, when operated in a boom lowering direction (forward direction), applies a pilot pressure in accordance with the operation amount to the right pilot port of the control valve 175R.

The operation sensor 29RA detects the content of the operation in the forward and backward directions by the operator relative to the right operation lever 26R and outputs a detected value to the controller 30.

The proportional valve 31BL operates in response to a control command (electric current command) output by the controller 30, thereby adjusting the pilot pressure of the hydraulic oil introduced from the pilot pump 15 to the right pilot port of the control valve 175L and the left pilot port of the control valve 175R through the proportional valve 31BL. The proportional valve 31BR operates in response to a control command (electric current command) output by the controller 30, thereby adjusting the pilot pressure of the hydraulic oil introduced from the pilot pump 15 to the right pilot port of the control valve 175R through the proportional valve 31BR. The proportional valve 31BL can adjust the pilot pressure so that the control valve 175L and the control valve 175R can be stopped at a given valve position. Also, the proportional valve 31BR can adjust the pilot pressure so that the control valve 175R can be stopped at a given valve position.

With this configuration, the controller 30 can feed the hydraulic oil discharged by the pilot pump 15 to the right pilot port of the control valve 175L and the left pilot port of the control valve 175R through the proportional valve 31BL in response to the boom raising operation by the operator. Also, the controller 30 can feed the hydraulic oil discharged by the pilot pump 15 to the right pilot port of the control valve 175L and the left pilot port of the control valve 175R through the proportional valve 31BL independently of the boom raising operation by the operator. That is, the controller 30 can raise the boom 4 in response to the boom raising operation by the operator or independently of the boom raising operation by the operator.

Also, the controller 30 can feed the hydraulic oil discharged by the pilot pump 15 to the right pilot port of the control valve 175R through the proportional valve 31BR in response to the boom lowering operation by the operator. Also, the controller 30 can feed the hydraulic oil discharged by the pilot pump 15 to the right pilot port of the control valve 175R through the proportional valve 31BR independently of the boom lowering operation by the operator. That is, the controller 30 can lower the boom 4 in response to the boom lowering operation by the operator or independently of the boom lowering operation by the operator.

As illustrated in FIG. 4C, the right operation lever 26R is used to operate the bucket 6. Specifically, the right operation lever 26R utilizes the hydraulic oil discharged by the pilot pump 15 to apply a pilot pressure to the pilot port of the control valve 174 in response to the operation in the leftward and rightward directions. More specifically, the right operation lever 26R, when operated in the bucket closing direction (leftward direction), applies a pilot pressure in accordance with the operation amount to the left pilot port of the control valve 174. The right operation lever 26R, when operated in the bucket opening direction (rightward direction), applies a pilot pressure in accordance with the operation amount to the right pilot port of the control valve 174.

The operation sensor 29RB detects the content of the operation in the leftward and rightward directions by the operator relative to the right operation lever 26R and outputs a detected value to the controller 30.

The proportional valve 31CL operates in response to a control command (electric current command) output by the controller 30, thereby adjusting the pilot pressure of the hydraulic oil introduced from the pilot pump 15 to the left pilot port of the control valve 174 through the proportional valve 31CL. The proportional valve 31CR operates in response to a control command (electric current command) output by the controller 30, thereby adjusting the pilot pressure of the hydraulic oil introduced from the pilot pump 15 to the right pilot port of the control valve 174 through the proportional valve 31CR. The proportional valve 31CL can adjust the pilot pressure so that the control valve 174 can be stopped at a given valve position. Similarly, the proportional valve 31CR can adjust the pilot pressure so that the control valve 174 can be stopped at a given valve position.

With this configuration, the controller 30 can feed the hydraulic oil discharged by the pilot pump 15 to the left pilot port of the control valve 174 through the proportional valve 31CL in response to the bucket closing operation by the operator. Also, the controller 30 can feed the hydraulic oil discharged by the pilot pump 15 to the left pilot port of the control valve 174 through the proportional valve 31CL independently of the bucket closing operation by the operator. That is, the controller 30 can close the bucket 6 in response to the bucket closing operation by the operator or independently of the bucket closing operation by the operator.

Also, the controller 30 can feed the hydraulic oil discharged by the pilot pump 15 to the right pilot port of the control valve 174 through the proportional valve 31CR in response to the bucket opening operation by the operator. Also, the controller 30 can feed the hydraulic oil discharged by the pilot pump 15 to the right pilot port of the control valve 174 through the proportional valve 31CR independently of the bucket opening operation by the operator. That is, the controller 30 can open the bucket 6 in response to the bucket opening operation by the operator or independently of the bucket opening operation by the operator.

As illustrated in FIG. 4D, the left operation lever 26L is used to operate the swiveling mechanism 2. Specifically, the left operation lever 26L utilizes the hydraulic oil discharged by the pilot pump 15 to apply a pilot pressure to the pilot port of the control valve 173 in response to the operation in the leftward and rightward directions. More specifically, the left operation lever 26L, when operated in the leftward swiveling direction (leftward direction), applies a pilot pressure in accordance with the operation amount to the left pilot port of the control valve 173. The left operation lever 26L, when operated in the rightward swiveling direction (rightward direction), applies a pilot pressure in accordance with the operation amount to the right pilot port of the control valve 173.

The operation sensor 29LB detects the content of the operation in the leftward and rightward directions by the operator relative to the left operation lever 26L and outputs a detected value to the controller 30.

The proportional valve 31DL operates in response to a control command (electric current command) output by the controller 30, thereby adjusting the pilot pressure of the hydraulic oil introduced from the pilot pump 15 to the left pilot port of the control valve 173 through the proportional valve 31DL. The proportional valve 31DR operates in response to a control command (electric current command) output by the controller 30, thereby adjusting the pilot pressure of the hydraulic oil introduced from the pilot pump 15 to the right pilot port of the control valve 173 through the proportional valve 31DR. The proportional valve 31DL can adjust the pilot pressure so that the control valve 173 can be stopped at a given valve position. Similarly, the proportional valve 31DR can adjust the pilot pressure so that the control valve 173 can be stopped at a given valve position.

With this configuration, the controller 30 can feed the hydraulic oil discharged by the pilot pump 15 to the left pilot port of the control valve 173 through the proportional valve 31DL in response to the leftward swiveling operation by the operator. Also, the controller 30 can feed the hydraulic oil discharged by the pilot pump 15 to the left pilot port of the control valve 173 through the proportional valve 31DL independently of the leftward swiveling operation by the operator. That is, the controller 30 can swivel the swiveling mechanism 2 leftward in response to the leftward swiveling operation by the operator or independently of the leftward swiveling operation by the operator.

Also, the controller 30 can feed the hydraulic oil discharged by the pilot pump 15 to the right pilot port of the control valve 173 through the proportional valve 31DR in response to the rightward swiveling operation by the operator. Also, the controller 30 can feed the hydraulic oil discharged by the pilot pump 15 to the right pilot port of the control valve 173 through the proportional valve 31DR independently of the rightward swiveling operation by the operator. That is, the controller 30 can swivel the swiveling mechanism 2 rightward in response to the rightward swiveling operation by the operator or independently of the rightward swiveling operation by the operator.

Also, as illustrated in FIG. 5A, the left traveling lever 26DL is used to operate the left crawler 1CL. Specifically, the left traveling lever 26DL utilizes the hydraulic oil discharged by the pilot pump 15 to apply a pilot pressure in accordance with the operation in the forward and backward directions to the pilot port of the control valve 171. More specifically, the left traveling lever 26DL, when operated in the traveling forward direction (forward direction), applies the pilot pressure in accordance with the operation amount to the left pilot port of the control valve 171. Also, the left traveling lever 26DL, when operated in the backward traveling direction (backward direction), applies the pilot pressure in accordance with the operation amount to the right pilot port of the control valve 171.

The operation sensor 29DL electrically detects the content of the operation by the operator in the forward and backward directions relative to the left traveling lever 26DL and outputs a detected value to the controller 30.

The proportional valve 31EL operates in response to an electric current command output by the controller 30. The proportional valve 31EL adjusts the pilot pressure of the hydraulic oil introduced from the pilot pump 15 to the left pilot port of the control valve 171 through the proportional valve 31EL. The proportional valve 31ER operates in response to an electric current command output by the controller 30. The proportional valve 31ER adjusts the pilot pressure of the hydraulic oil introduced from the pilot pump 15 to the right pilot port of the control valve 171 through the proportional valve 31ER. The proportional valves 31EL and 31ER can adjust the pilot pressure so that the control valve 171 can be stopped at a given valve position.

With this configuration, the controller 30 can feed the hydraulic oil discharged by the pilot pump 15 to the left pilot port of the control valve 171 through the proportional valve 31EL independently of the forward left traveling operation by the operator. That is, the left crawler 1CL can be caused to travel forward. Also, the controller 30 can feed the hydraulic oil discharged by the pilot pump 15 to the right pilot port of the control valve 171 through the proportional valve 31ER independently of the left traveling backward operation by the operator. That is, the left crawler 1CL can be caused to travel backward.

Also, as illustrated in FIG. 5B, the right traveling lever 26DR is used to operate the right crawler 1CR. Specifically, the right traveling lever 26DR utilizes the hydraulic oil discharged by the pilot pump 15 to apply a pilot pressure in accordance with the operation in the forward and backward directions to the pilot port of the control valve 172. More specifically, the right traveling lever 26DR, when operated in the traveling forward direction (forward direction), applies the pilot pressure in accordance with the operation amount to the right pilot port of the control valve 172. Also, the right traveling lever 26DR, when operated in the backward traveling direction (the backward direction), applies the pilot pressure in accordance with the operation amount to the right pilot port of the control valve 172.

The operation sensor 29DR electrically detects the content of the operation by the operator in the forward and backward directions relative to the right traveling lever 26DR and outputs a detected value to the controller 30.

The proportional valve 31FL operates in response to an electric current command output by the controller 30. The proportional valve 31FL adjusts the pilot pressure of the hydraulic oil introduced from the pilot pump 15 to the left pilot port of the control valve 172 through the proportional valve 31FL. The proportional valve 31FR operates in response to an electric current command output by the controller 30. The proportional valve 31FR adjusts the pilot pressure of the hydraulic oil introduced from the pilot pump 15 to the right pilot port of the control valve 172 through the proportional valve 31FR. The proportional valves 31FL and 31FR can adjust the pilot pressure so that the control valve 172 can be stopped at a given valve position.

With this configuration, the controller 30 can feed the hydraulic oil discharged by the pilot pump 15 to the right pilot port of the control valve 172 through the proportional valve 31FL independently of the forward right traveling operation by the operator. That is, the right crawler 1CR can be caused to travel forward. Also, the controller 30 can feed the hydraulic oil discharged by the pilot pump 15 to the left pilot port of the control valve 172 through the proportional valve 31FR independently of the right traveling backward operation by the operator. That is, the right crawler 1CR can be caused to travel backward.

Also, the shovel 100 may include a structure configured to automatically operate a bucket tilt mechanism. In this case, a part of the hydraulic system in relation to a bucket tilt cylinder forming the bucket tilt mechanism may be configured in the same manner as in, for example, the part of the hydraulic system in relation to the operation of the boom cylinder 7.

Although the operation device 26 that is an electric operation lever has been described, the operation device 26 may be a hydraulic operation lever rather than the electric operation lever. In this case, the amount of the lever operation of the hydraulic operation lever may be detected by a pressure sensor in the form of pressure and input to the controller 30. Also, an electromagnetic valve may be disposed between the operation device 26 that is the hydraulic operation lever, and the pilot port of each of the control valves. The electromagnetic valve is configured to operate in response to an electric signal from the controller 30. With this configuration, in response to manually operating the operation device 26 that is the hydraulic operation lever, the operation device 26 increases or decreases a pilot pressure in accordance with the amount of the lever operation, thereby moving each of the control valves. Also, each of the control valves may be configured with an electromagnetic spool valve. In this case, the electromagnetic spool valve operates in response to an electric signal from the controller 30 corresponding to the amount of the lever operation of the electric operation lever.

Figure 6:
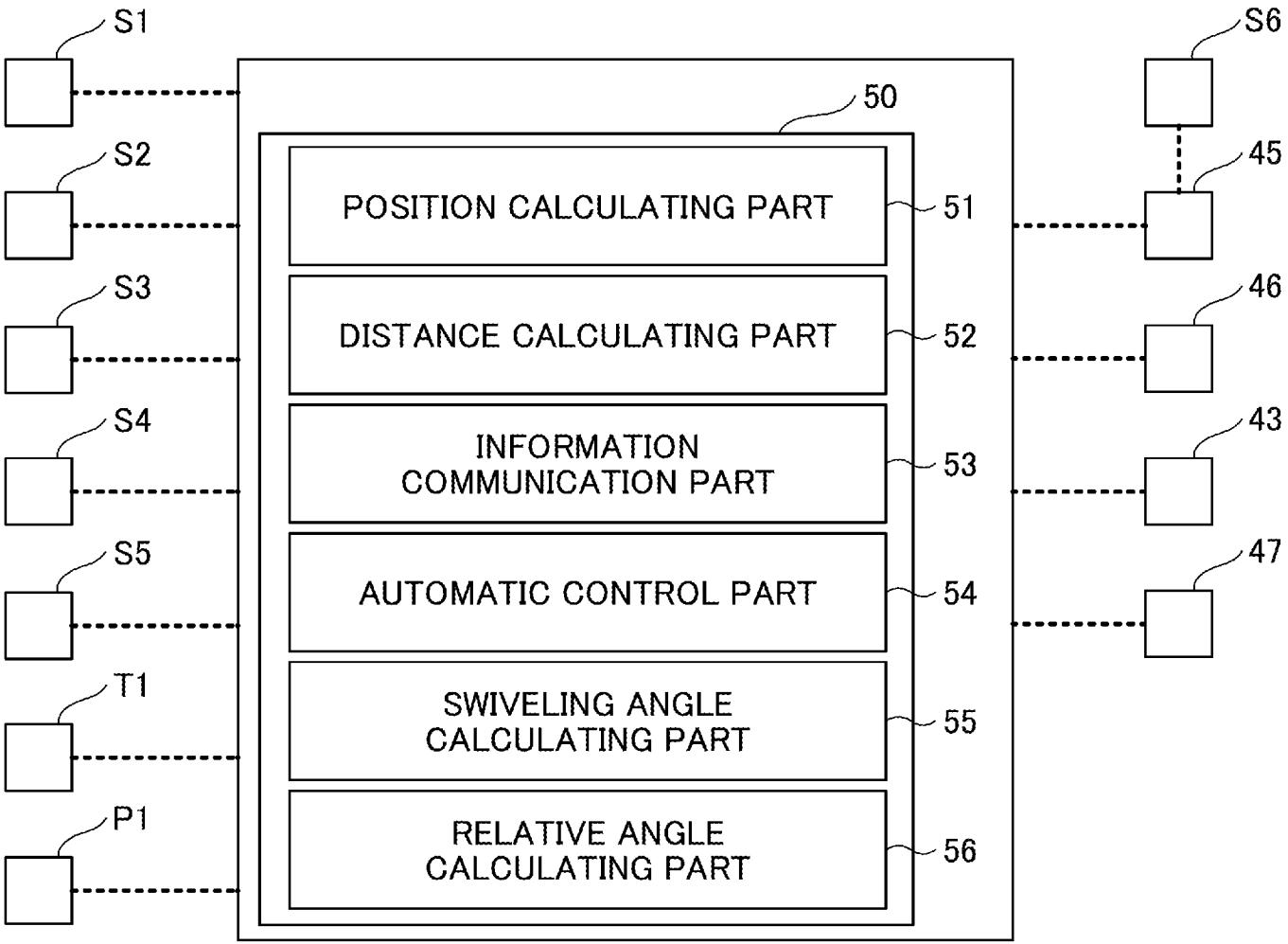
FIG. 6 is a block diagram illustrating another configuration example of the driving system of the shovel of FIG. 1.

Next, a configuration example of the machine control device 50 will be described with reference to FIG. 6. FIG. 6 is a block diagram illustrating the configuration example of the machine control device 50. Specifically, the machine control device 50 obtains information from, for example, the boom angle sensor S1, the arm angle sensor S2, the bucket angle sensor S3, the machine body tilt sensor S4, the swivel angular velocity sensor S5, the camera S6, the position measurement device P1, the communication device T1, the input device 46, or any combination thereof. The machine control device 50, for example, calculates the distance between the bucket 6 and the target construction surface based on the obtained information and communicates the distance between the bucket 6 and the target construction surface to the operator of the shovel 100 with sound, image display, or both. Also, the machine control device 50 includes a position calculating part 51, a distance calculating part 52, an information communication part 53, and an automatic control part 54.

The position calculating unit 51 is configured to calculate a position of an object to be measured for the position thereof. In the present embodiment, the position calculating part 51 calculates a coordinate point of the working portion of the attachment in the reference coordinate system. Specifically, the position calculating part 51 calculates the coordinate point of the tip end (toe) of the bucket 6 from the respective rotation angles of the boom 4, the arm 5, and the bucket 6. The position calculating part 51 may calculate not only the coordinate point of the center of the toe of the bucket 6 but also the coordinate point of the left end of the toe of the bucket 6 and the coordinate point of the right end of the toe of the bucket 6.

The distance calculating part 52 is configured to calculate the distance between two objects to be measured for the positions thereof. In the present embodiment, the distance calculating part 52 calculates the vertical distance between the toe of the bucket 6 and the target construction surface. The distance calculating part 52 may calculate distances (e.g., the vertical distances) between the respective coordinate points of the left end and the right end of the toe of the bucket 6 and the target construction surface corresponding thereto so that the machine control device 50 can determine whether or not the shovel 100 faces the target construction surface straight.

The information communication part 53 is configured to communicate various information to the operator of the shovel 100. In the present embodiment, the information communication part 53 communicates various distances calculated by the distance calculating part 52 to the operator of the shovel 100. Specifically, the vertical distance between the toe of the bucket 6 and the target construction surface is communicated to the operator of the shovel 100 using visual information, audio information, or both.

For example, the information communication part 53 may communicate the length of the vertical distance between the toe of the bucket 6 and the target construction surface to the operator using an intermittent sound generated by the sound output device 43. In this case, the information communication part 53 may shorten intervals of the intermittent sound as the vertical distance decreases. The information communication part 53 may use a continuous sound and may change, for example, a pitch of the sound, strength of the sound, or both, thereby indicating a difference in the length of the vertical distance. The information communication part 53 may issue an alarm when the toe of the bucket 6 becomes lower than the target construction surface. The alarm is, for example, a continuous sound that is significantly greater than the intermittent sound.

The information communication part 53 may display the length of the vertical distance between the toe of the bucket 6 and the target construction surface as the work information on the display device 45. The display device 45 displays, for example, the work information received from the information communication part 53 together with image data received from the camera S6, on the screen. The information communication part 53 may communicate the length of the vertical distance to the operator using, for example, an image of an analog meter or an image of a bar graph indicator.

The automatic control part 54 automatically operates the actuator to automatically assist the manual operation of the shovel 100 performed by the operator. For example, when the operator manually performs the arm closing operation, the automatic control part 54 may automatically extend and retract the boom cylinder 7, the arm cylinder 8, the bucket cylinder 9, or any combination thereof so that the target construction surface coincides with the position of the toe of the bucket 6. In this case, the operator can close the arm 5 with the toe of the bucket 6 coinciding with the target construction surface by, for example, simply operating the arm operation lever in the closing direction. The automatic control may be configured to be performed when a predetermined switch, which is one of the input devices 46, is pressed. The predetermined switch is, for example, a machine control switch (hereinafter referred to as an "MC switch") and may be disposed as a knob switch at an end of the operation device 26.

The automatic control part 54 may automatically rotate the swiveling hydraulic motor 2A in order to cause the upper swiveling body 3 to face the target construction surface straight when the predetermined switch (e.g., the MC switch) is pressed with a "straight facing control mode" being set. In this case, the operator can cause the upper swiveling body 3 to face the target construction surface straight by simply pressing the predetermined switch or operating a swiveling operation lever while pressing the predetermined switch. Alternatively, the operator can cause the upper swiveling body 3 to face the target construction surface straight and start the machine control function by simply pressing the predetermined switch. In the following, the control of causing the upper swiveling body 3 to face the target construction surface straight is referred to as "straight facing control". In the straight facing control, the machine control device 50 determines that the shovel 100 faces the target construction surface straight when the vertical distance at the left end, which is the vertical distance between the coordinate point at the left end of the toe of the bucket 6 and the target construction surface, is equal to the vertical distance at the right end, which is the vertical distance between the coordinate point at the right end of the toe of the bucket 6 and the target construction surface. However, the machine control device 50 may determine that the shovel 100 faces the target construction surface straight when the difference between the vertical distance at the left end and the vertical distance at the right end is smaller than or equal to a predetermined value, which is not when the vertical distance at the left end is equal to the vertical distance at the right end, that is, which is not when the difference between the vertical distance at the left end and the vertical distance at the right end is zero. The machine control device 50 may inform the operator that the straight facing control has been completed, using visual information, audio information, or both when the machine control device 50 determines that the shovel 100 faces the target construction surface straight after automatically rotating the swiveling hydraulic motor 2A. That is, the machine control device 50 may inform the operator that the upper swiveling body 3 faces the target construction surface straight.

In the present embodiment, the automatic control part 54 can automatically operate each actuator by individually and automatically adjusting the pilot pressure applied to the control valve corresponding to each actuator. For example, in the straight facing control, the automatic control part 54 may operate the swiveling hydraulic motor 2A based on the difference between the vertical distance at the left end and the vertical distance at the right end. Specifically, when the swiveling operation lever is operated while the predetermined switch is pressed, the automatic control part 54 determines whether or not the swiveling operation lever is operated in a direction in which the upper swiveling body 3 faces the target construction surface straight. For example, when the swiveling operation lever is operated in a direction in which the vertical distance between the toe of the bucket 6 and the target construction surface (backslope) is increased, the automatic control part 54 does not perform the straight facing control. When the swiveling operation lever is operated in a direction in which the vertical distance between the toe of the bucket 6 and the target construction surface (backslope) is reduced, the automatic control part 54 performs the straight facing control. As a result, the automatic control part 54 can operate the swiveling hydraulic motor 2A so that the difference between the vertical distance at the left end and the vertical distance at the right end becomes smaller. Subsequently, the automatic control part 54 stops the swiveling hydraulic motor 2A when the difference is smaller than or equal to the predetermined value or is zero. Alternatively, the automatic control part 54 may set the swiveling angle at which the difference is smaller than or equal to the predetermined value or is zero as a target angle, and perform swiveling angle control so that a difference in the angle between the target angle and the current swiveling angle (detected value) becomes zero. In this case, the swiveling angle is, for example, the angle of a front-back axis of the upper swiveling body 3 with respect to the reference direction.

When an operation with respect to the target construction surface, such as an excavating operation or a slope finishing operation, is performed, the automatic control part 54 may automatically operate the actuator so that the upper swiveling body 3 maintains to face the target construction surface straight. For example, when the direction of the upper swiveling body 3 is changed due to excavation reaction forces or the like and the upper swiveling body 3 does not face the target construction surface straight, the automatic control part 54 may automatically operate the swiveling hydraulic motor 2A to cause the upper swiveling body 3 to immediately face the target construction surface straight. Alternatively, when the operation with respect to the target construction surface is being performed, the automatic control part 54 may proactively operate the actuator to prevent the direction of the upper swiveling body 3 from being changed due to excavation reaction forces or the like.

Also, the machine control device 50 further includes a swiveling angle calculating part 55 and a relative angle calculating part 56.

The swiveling angle calculating part 55 calculates the swiveling angle of the upper swiveling body 3. This is to determine the current direction of the upper swiveling body 3. In the present embodiment, the swiveling angle calculating part 55 calculates the angle of the front-back axis of the upper swiveling body 3 with respect to the reference direction based on an output of the GNSS compass as the position measurement device P1, as the swiveling angle. The swiveling angle calculating part 55 may calculate the swiveling angle based on an output of the swivel angular velocity sensor S5. When the reference point is set in the construction site, the swiveling angle calculating part 55 may use a direction in which the reference point is viewed from a swiveling axis as the reference direction.

The swiveling angle indicates a direction in which the attachment operation surface extends. The attachment operation surface is, for example, a virtual plane that crosses the attachment in a longitudinal direction and is positioned perpendicular to a swiveling plane. The swiveling plane is, for example, a virtual plane including a bottom surface of a swiveling frame perpendicular to the swiveling axis. The machine control device 50, for example, determines that the upper swiveling body 3 faces the target construction surface straight when the machine control device 50 determines that an attachment operation plane AF (see FIG. 9A) includes a normal to the target construction surface.

The relative angle calculating part 56 calculates the relative angle as the swiveling angle necessary to cause the upper swiveling body 3 to face the target construction surface straight. The relative angle is, for example, a relative angle formed between a direction of the front-back axis of the upper swiveling body 3 when the upper swiveling body 3 faces the target construction surface straight and the current direction of the front-back axis of the upper swiveling body 3. In the present embodiment, the relative angle calculating part 56 calculates the relative angle based on the information related to the target construction surface stored in the storage device 47 and the swiveling angle calculated by the swiveling angle calculating part 55.

When the swiveling operation lever is operated while the predetermined switch is pressed, the automatic control part 54 determines whether or not the swiveling operation lever is operated in a direction of causing the upper swiveling body 3 to face the target construction surface straight. When the automatic control part 54 determines that the swiveling operation lever is operated in the direction of causing the upper swiveling body 3 to face the target construction surface, the automatic control part 54 sets the relative angle calculated by the relative angle calculating part 56 as the target angle. When the change of the swiveling angle after the rotation operation lever has been operated reaches the target angle, the automatic control part 54 determines that the upper swiveling body 3 faces the target construction surface straight, and stops the movement of the swiveling hydraulic motor 2A.

In this way, the machine control device 50 can cause the upper swiveling body 3 to face the target construction surface straight.

Figure 7:
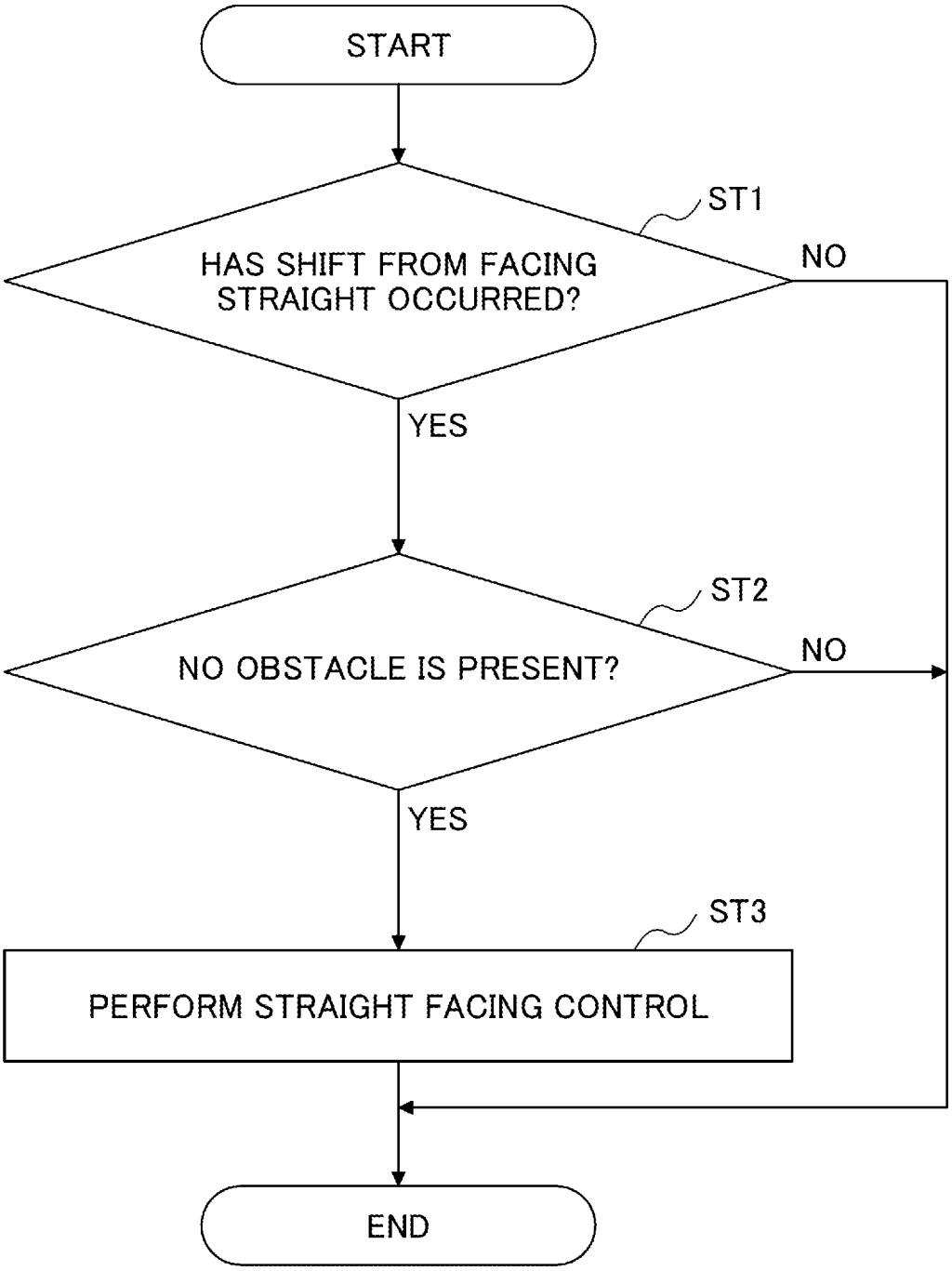
FIG. 7 is a flowchart of a straight facing process.
Figure 8A:
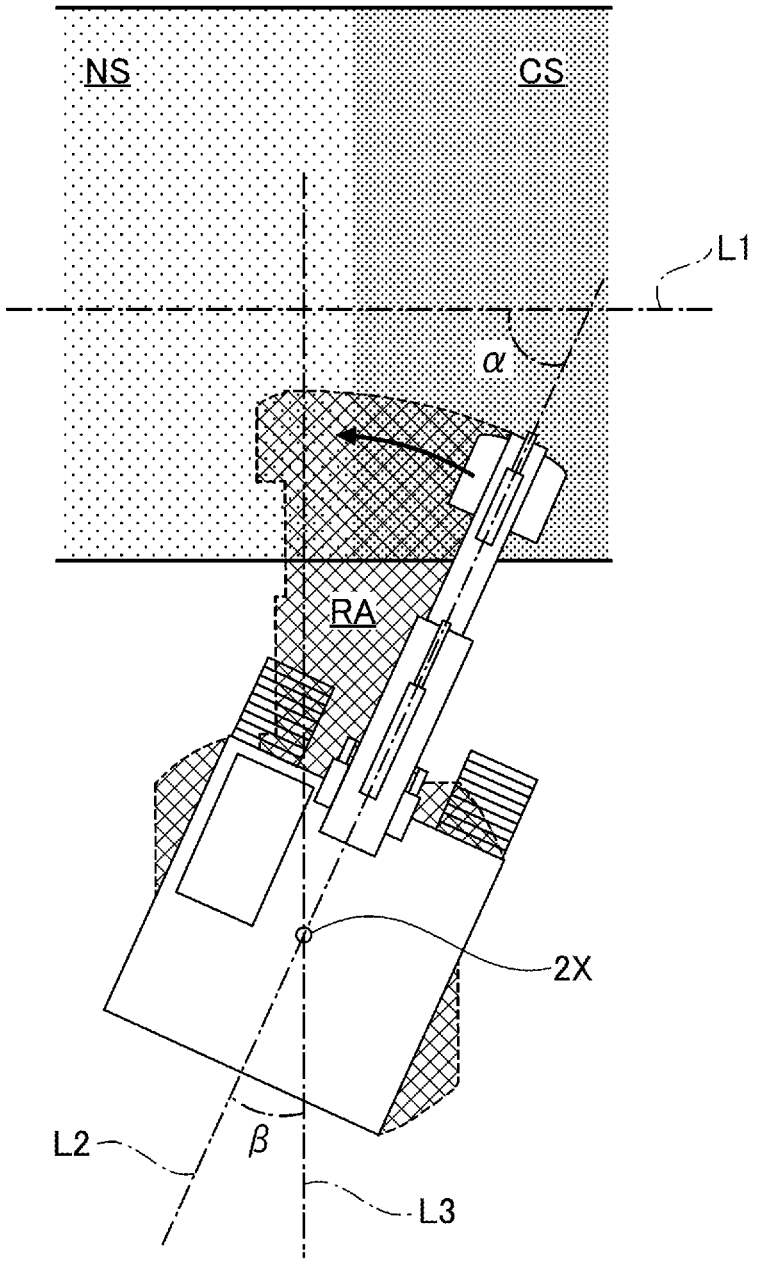
FIG. 8A is a top view of the shovel upon performing the straight facing process.
Figure 8B:
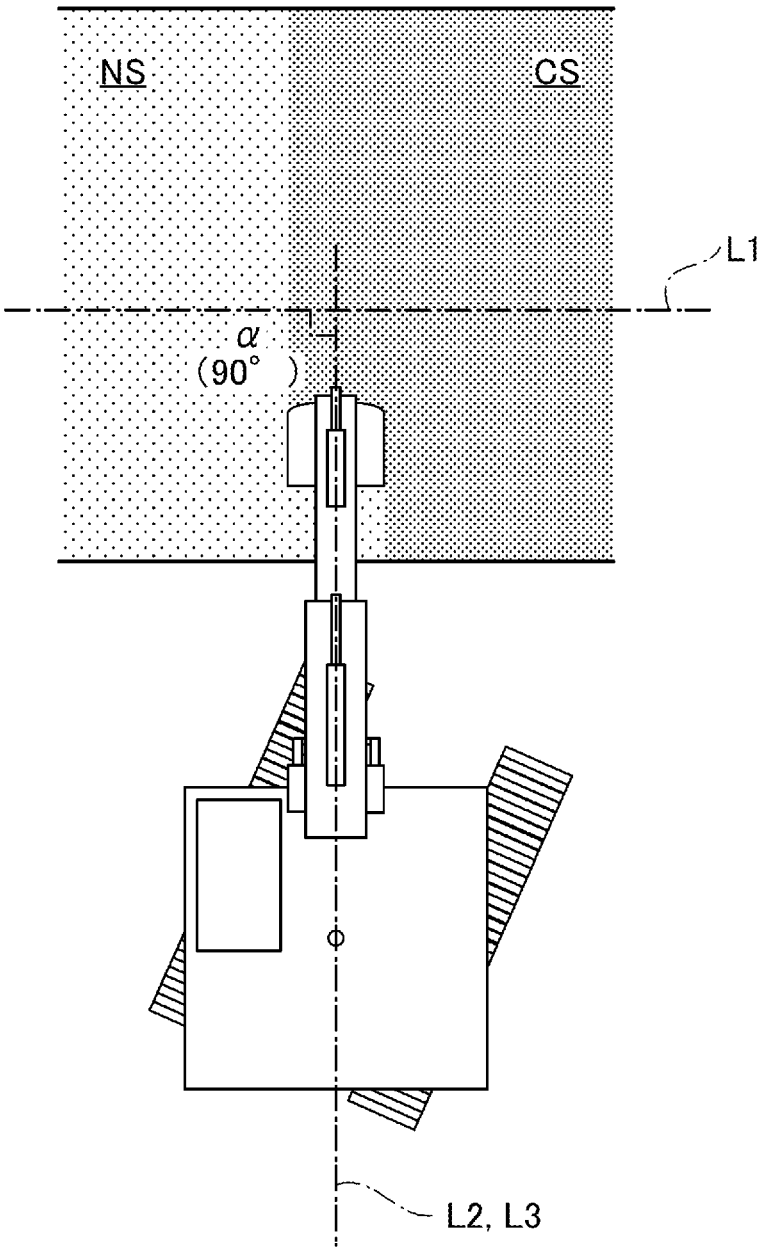
FIG. 8B is a top view of the shovel upon performing the straight facing process.
Figure 9A:
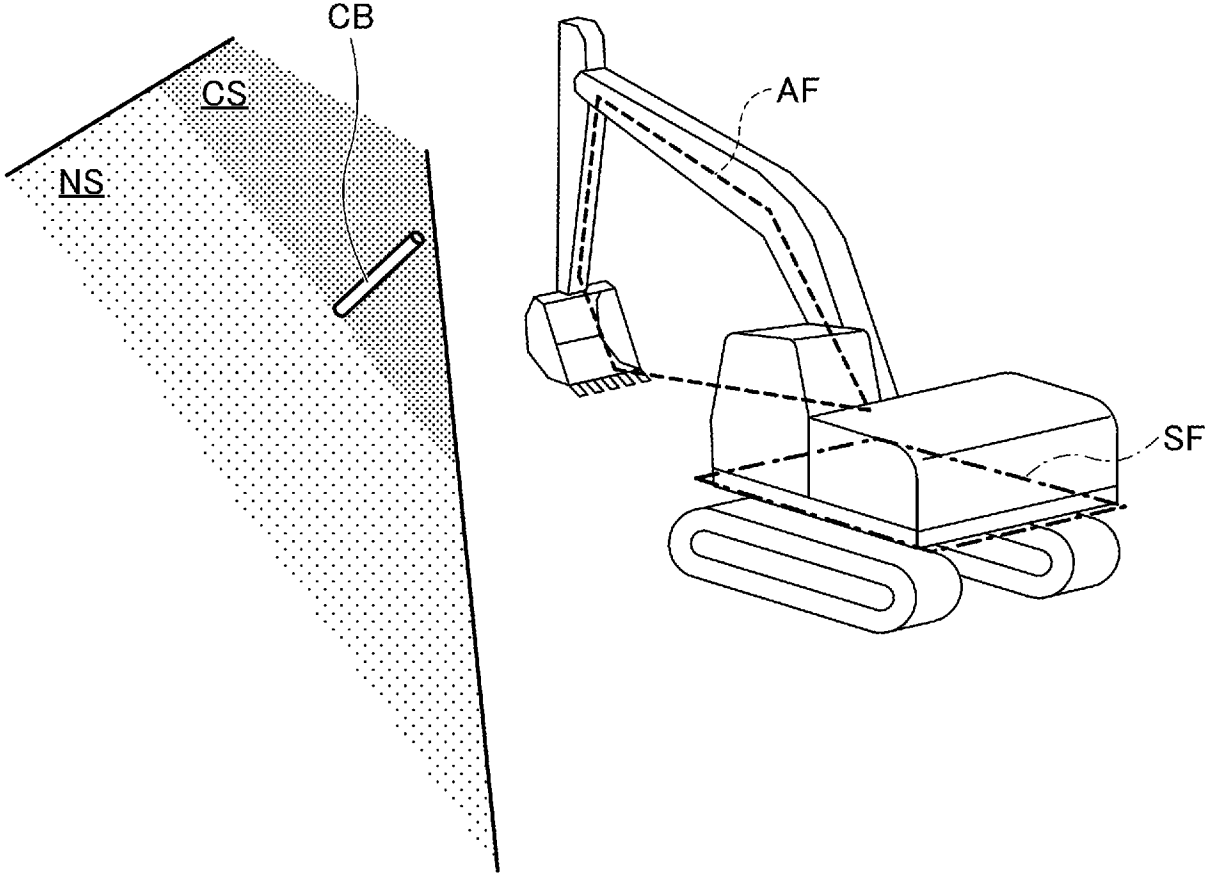
FIG. 9A is a perspective view of the shovel upon performing the straight facing process.
Figure 9B:
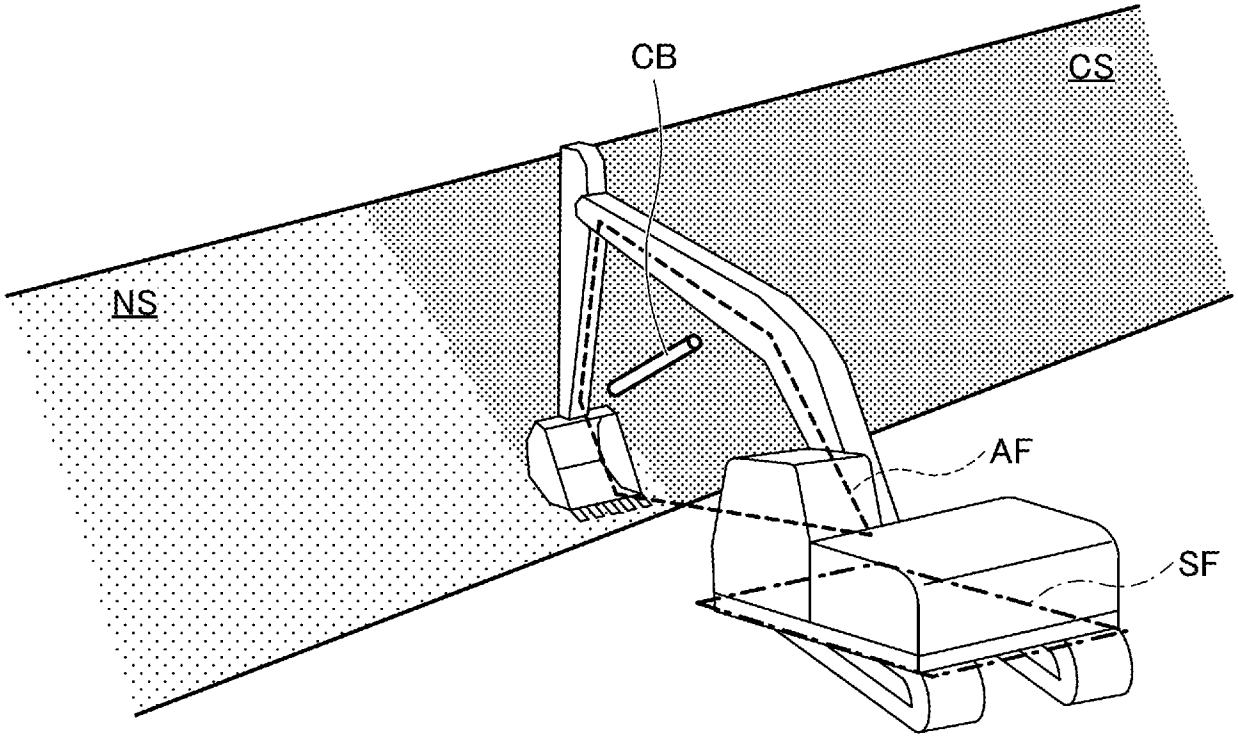
FIG. 9B is a perspective view of the shovel upon performing the straight facing process.

Next, with reference to FIGS. 7 to 9, an example of a process in which the controller 30 causes the upper swiveling body 3 to face the target construction surface straight (hereinafter referred to as a "straight facing process") will be described. FIG. 7 is a flowchart of the straight facing process. The controller 30 performs the straight facing process when the MC switch is pressed. FIG. 8A and FIG. 8B are each a top view of the shovel 100 upon performing the straight facing process. FIG. 9A and FIG. 9B are each a perspective view of the shovel 100 upon performing the straight facing process when the shovel 100 is viewed from the left back. Specifically, FIG. 8A and FIG. 9A illustrate a state in which the upper swiveling body 3 does not face the target construction surface straight, and FIG. 8B and FIG. 9B illustrate a state in which the upper swiveling body 3 faces the target construction surface straight. In FIG. 8A, FIG. 8B, FIG. 9A, and FIG. 9B, the target construction surface set under a ground surface ES is a backslope BS as illustrated in, for example, FIG. 1. A region NS represents a state in which the backslope BS is not completed, that is, a state in which the ground surface ES does not match the backslope BS as illustrated in FIG. 1, and a region CS represents a state in which the backslope BS is completed, that is, the ground surface ES matches the backslope BS. In FIG. 8A, FIG. 8B, FIG. 9A, and FIG. 9B, for ease of understanding, the region NS is given a rough dot pattern, and the region CS is given a fine dot pattern.

The state in which the upper swiveling body 3 faces the target construction surface straight, includes, for example, a state in which an angle α formed between a line segment L1 representing the direction (extending direction) of the target construction surface and a line segment L2 representing the front-back axis of the upper swiveling body 3 is 90 degrees on a virtual horizontal plane, as illustrated in FIG. 8B. The extending direction of the slope as the direction of the target construction surface, which is represented by the line segment L1, is a direction orthogonal to a slope length direction, for example. The slope length direction is, for example, a direction along a virtual line segment connecting the top (shoulder) and the bottom (foot) of the slope at the shortest distance. A state in which the upper swiveling body 3 faces the target construction surface straight may be defined as a state in which an angle β (see FIG. 8A) formed between the line segment L2 representing the front-back axis of the upper swiveling body 3 and a line segment L3 perpendicular to the direction (extending direction) of the target construction surface is 0 degrees on the virtual horizontal plane. A direction represented by the line segment L3 corresponds to a direction of a horizontal component of a perpendicular line drawn to the target construction surface.

A virtual cylinder CB of FIG. 9A and FIG. 9B represents a portion of the normal to the target construction surface (the backslope BS), a dash-dotted line represents a portion of a virtual swivel plane SF, and a dashed line represents a portion of the virtual attachment operation plane AF. The attachment operation plane AF is arranged to be perpendicular to the swivel plane SF. As illustrated in FIG. 9B, when the upper swiveling body 3 is in a state of facing the target construction surface straight, the attachment operation plane AF is arranged so that the attachment operation plane AF includes the portion of the normal as represented by the virtual cylinder CB, that is, the attachment operation plane AF extends along the portion of the normal.

The automatic control part 54, for example, sets the swiveling angle formed when the attachment operation plane AF and the target construction surface (the backslope BS) are perpendicular to each other, as the target angle. The automatic control part 54 detects the current swiveling angle based on the output of the position measurement device P1 or the like and calculates a difference between the target angle and the current swiveling angle (detected value). The automatic control part 54 operates the swiveling hydraulic motor 2A so that the difference is smaller than or equal to a predetermined value or is zero. Specifically, when the difference between the target angle and the current swiveling angle is smaller than or equal to the predetermined value or is zero, the automatic control part 54 determines that the upper swiveling body 3 faces the target construction surface straight. When the swiveling operation lever is operated while the predetermined switch is pressed, the automatic control part 54 determines whether or not the swiveling operation lever is operated in a direction of causing the upper swiveling body 3 to face the target construction surface straight. For example, when the swiveling operation lever is operated in a direction in which the difference between the target angle and the current swiveling angle increases, the automatic control part 54 determines that the swiveling operation lever is not operated in a direction of causing the upper swiveling body 3 to face the target construction surface straight, and does not perform the straight facing control. When the swiveling operation lever is operated in a direction in which the difference between the target angle and the current swiveling angle decreases, the automatic control part 54 determines that the swiveling operation lever is operated in a direction of causing the upper swiveling body 3 to face the target construction surface straight, and performs the straight facing control. As a result, the swiveling hydraulic motor 2A can be operated so that the difference between the target angle and the current swiveling angle decreases. Subsequently, the automatic control part 54 stops the swiveling hydraulic motor 2A when the difference between the target angle and the current swiveling angle is smaller than or equal to the predetermined value or is zero.

The example illustrated in FIG. 8B is an example indicating a state in which the attachment operation plane AF includes the normal (the virtual cylinder CB), and the angle α formed between the line segment L1 representing the direction of the target construction surface and the line segment L2 representing the front-back axis of the upper swiveling body 3 is 90 degrees. However, as long as the attachment operation plane AF is in a state of including the normal (the virtual cylinder CB), the angle α is not necessarily required to be 90 degrees. For example, since the shovel 100 is often installed on a ground with large relief, even if the attachment operation plane AF is in the state of including the normal (the virtual cylinder CB), the angle α is not necessarily 90 degrees.

Based on the above description of FIG. 8A, FIG. 8B, FIG. 9A, and FIG. 9B, a flow of the straight facing control will be described with reference to FIG. 7 again. First, the machine control device 50 included in the controller 30 determines whether or not a shift from facing straight has occurred (step ST1). In the present embodiment, the machine control device 50 determines whether or not a shift from facing straight has occurred based on the information related to the target construction surface previously stored in the storage device 47 and the output of the position measurement device P1 as the direction detecting device. The information related to the target construction surface includes information related to the direction of the target construction surface. The position measurement device P1 outputs information related to the direction of the upper swiveling body 3. For example, as illustrated in FIG. 9A, in a state in which the attachment operation plane AF does not include the normal to the target construction surface, the machine control device 50 determines that a shift from facing the target construction surface straight from the shovel 100 has occurred. In such a state, as illustrated in FIG. 8A, the angle α formed between the line segment L1 representing the direction of the target construction surface and the line segment L2 representing the direction of the upper swiveling body 3 is an angle other than 90 degrees.

Note that, the machine control device 50 may determine whether or not a shift from facing straight has occurred based on an image taken by the camera S6. For example, the machine control device 50 may, by performing various image processing on the image taken by the camera S6 to derive information related to the shape of the slope to be worked on, determine whether or not a shift from facing straight has occurred based on the derived information. Alternatively, the machine control device 50 may determine whether or not a shift from facing straight has occurred based on an output of a space recognition device other than the camera S6, such as an ultrasonic sensor, a millimeter wave radar, a distance image sensor, a LIDAR sensor, or an infrared sensor.

When it is determined that a shift from facing straight has not occurred (NO in step ST1), the machine control device 50 terminates the current straight facing process without performing the straight facing control.

When it is determined that a shift from facing straight has occurred (YES in step ST1), the machine control device 50 determines whether or not no obstacle is present around the shovel 100 (in step ST2). In the present embodiment, the machine control device 50 performs image recognition processing on the image taken by the camera S6 to determine whether or not an image related to a predetermined obstacle exists in the taken image. The predetermined obstacle is, for example, a person, an animal, a machine, a building, or any combination thereof. Then, when it is determined that no image related to the predetermined obstacle exists in an image related to a predetermined area that is set around the shovel 100, it is determined that no obstacle is present around the shovel 100. The predetermined area includes, for example, an area in which there can be an object that comes into contact with the shovel 100 when the shovel 100 is moved to cause the upper swiveling body 3 to face the target construction surface straight. An area RA, which is represented by a cross hatching pattern in FIG. 8A, is an example of the predetermined area. However, the predetermined area may be set as a wider area, such as an area within a predetermined distance from a swiveling axis 2X.

The machine control device 50 may determine whether or not no obstacle is present around the shovel 100 based on an output of a space recognition device other than the camera S6, such as an ultrasonic sensor, a millimeter wave radar, a distance image sensor, a LIDAR sensor, or an infrared sensor.

When it is determined that an obstacle is present around the shovel 100 (NO in step ST2), the machine control device 50 terminates the current straight facing process without performing the straight facing control. This is to prevent the shovel 100 from contacting the obstacle by performing the straight facing control. In this case, the machine control device 50 may output an alarm. The machine control device 50 may send information related to the obstacle, such as the presence or absence of the obstacle, the location of the obstacle, and the type of the obstacle, to the external device through the communication device T1. The machine control device 50 may receive information related to the obstacle obtained by another shovel through the communication device T1.

When it is determined that no obstacle is present around the shovel 100 (YES in step ST2), the machine control device 50 performs the straight facing control (in step ST3). In the examples of FIG. 8A, FIG. 8B, FIG. 9A, and FIG. 9B, the automatic control part 54 of the machine control device 50 outputs an electric current command to the proportional valve 31CL (see FIG. 4C). The pilot pressure generated by the hydraulic oil passing through the proportional valve 31CL and the shuttle valve CL from the pilot pump 15 is applied to the left pilot port of the control valve 173. The control valve 173 receiving the pilot pressure at the left pilot port is displaced in the right direction to cause the hydraulic oil discharged by the left main pump 14L to flow into a first port 2A1 of the swiveling hydraulic motor 2A. The control valve 173 causes the hydraulic oil that flows out from a second port 2A2 of the swiveling hydraulic motor 2A to flow out to the hydraulic oil tank. As a result, the swiveling hydraulic motor 2A rotates in a forward direction and swivels the upper swiveling body 3 in the left direction about the swiveling axis 2X as indicated by the arrow in FIG. 8A. Subsequently, as illustrated in FIG. 8B, the automatic control part 54 stops the output of the electric current command to the proportional valve 31CL at 90 degrees of the angle $\alpha$ or at 0 degrees of the angle $\beta$ and reduces the pilot pressure applied to the left pilot port of the control valve 173. The control valve 173 is displaced in the left direction to return to a neutral position, and blocks the flow of the hydraulic oil from the left main pump 14L toward the first port 2A1 of the swiveling hydraulic motor 2A. Also, the control valve 173 blocks the flow of the hydraulic oil from the second port 2A2 of the swiveling hydraulic motor 2A toward the hydraulic oil tank. As a result, the swiveling hydraulic motor 2A stops the rotation in the forward direction and stops swiveling the upper swiveling body 3 in the left direction.

Figure 10A:
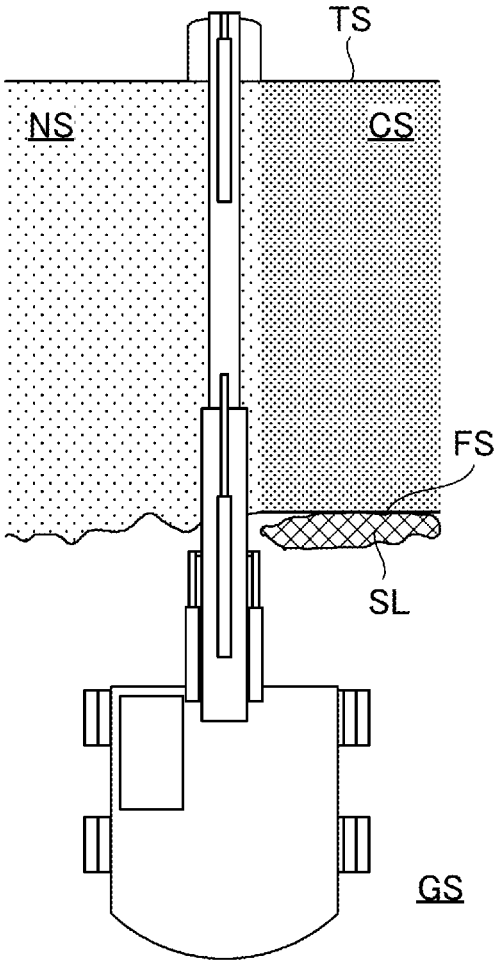
FIG. 10A is a top view of the shovel upon performing a slope finishing process.
Figure 10B:
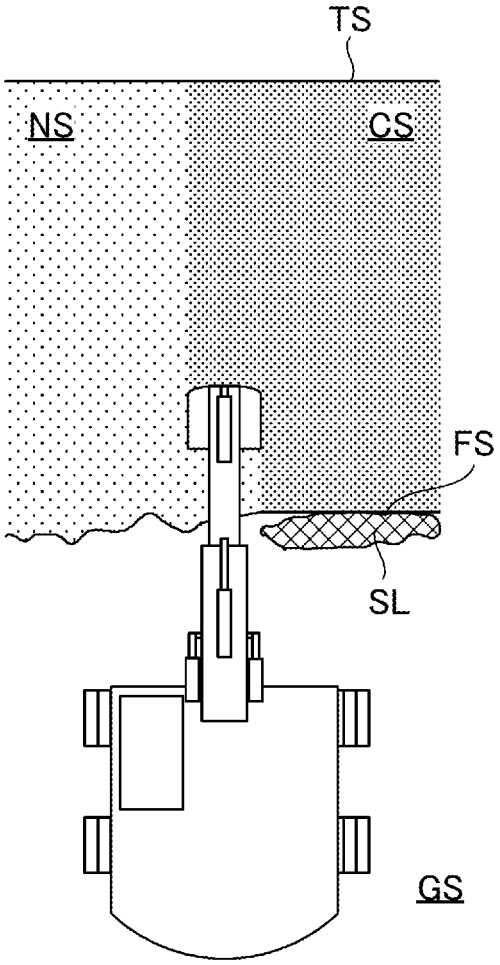
FIG. 10B is a top view of the shovel upon performing the slope finishing process.

Next, with reference to FIG. 10A and FIG. 10B, a process in which the machine control device 50 assists an operation for finishing a slope (slope finishing process) will be described. FIG. 10A and FIG. 10B are each a top view of the shovel 100 that finishes a slope. Specifically, FIG. 10A is a top view of the shovel 100 in which the tip end (toe) of the bucket 6 is positioned at a slope top TS of the backslope BS, and FIG. 10B is a top view of the shovel 100 in which the toe of the bucket 6 is positioned at a position close to a slope toe FS of the backslope BS. In FIG. 10A and FIG. 10B, for easiness of understanding, the region NS, in which the backslope BS is not completed, is given a rough dot pattern, and the region CS, in which the backslope BS is completed, is given a fine dot pattern. Also, in FIG. 10A and FIG. 10B, a cross pattern is given to soil and sand SL deposited near the slope toe FS after rolling down over the backslope BS upon a slope finishing operation. Also, it is illustrated in FIG. 10A and FIG. 10B that a straight boundary line corresponding to the slope toe FS as in the region CS (boundary line between the backslope BS and a ground surface GS on which the shovel 100 is located) has not yet been formed at the lower end portion of the region NS.

For example, after completion of the straight facing process, when the left operation lever 26L is operated in the arm opening direction with the switch SW1 being pressed, the automatic control part 54 automatically operates the excavating attachment so that the toe of the bucket 6 is positioned at the slope top TS of the backslope BS. Specifically, the automatic control part 54 automatically performs a boom lowering movement, an arm opening movement, and a bucket opening movement. Subsequently, as illustrated in FIG. 10A, the automatic control part 54 stops the movement of the excavating attachment when the toe of the bucket 6 is positioned at the slope top TS. In the examples as illustrated in FIG. 10A and FIG. 10B, even if the left operation lever 26L is being operated in the arm opening direction, the automatic control part 54 stops the movement of the excavating attachment. Note that, the slope top TS is a dot or a line on the backslope BS that is the target construction surface, and information related to the target construction surface is stored in the storage device 47 in advance.

Subsequently, for example, when the left operation lever 26L is operated in the arm closing direction with a "finishing control mode" being set and the switch SW1 being pressed, the automatic control part 54 moves the toe of the bucket 6 from the slope top TS to the slope toe FS over the backslope BS that is the target construction surface. At this time, the soil and sand scraped off from the slope surface roll down over the slope surface and are deposited as the soil and sand SL near the slope surface of the ground surface GS on which the shovel 100 is located. Typically, the soil and sand SL are deposited so as to cover a portion where the slope toe FS is to be formed.

Subsequently, when the toe of the bucket 6 reaches the slope toe FS, the automatic control part 54 stops the movement of the excavating attachment. In the examples as illustrated in FIG. 10A and FIG. 10B, even if the left operation lever 26L is being operated in the arm closing direction, the automatic control part 54 stops the movement of the excavating attachment.

Through the above-described slope finishing process, the operator of the shovel 100 can complete finishing of one section of the backslope BS by simply operating the left operation lever 26L in the arm opening direction or in the arm closing direction. Note that, the section of the backslope BS is a part of the slope surface having a width corresponding to the bucket width and extending from the slope top TS to the slope toe FS.

Subsequently, for example, the operator of the shovel 100 may perform the swiveling operation and remove the soil and sand included in the bucket 6 backward of the shovel 100. Subsequently, the operator may perform the traveling operation for driving the lower traveling body 1 (traveling hydraulic motor 2M) and move the shovel 100 leftward by the bucket width. Further subsequently, the operator may perform the straight facing process to cause the shovel 100 to face the next section of the backslope BS straight, and may perform the slope finishing process to complete finishing of that section of the backslope BS.

Figure 11A:
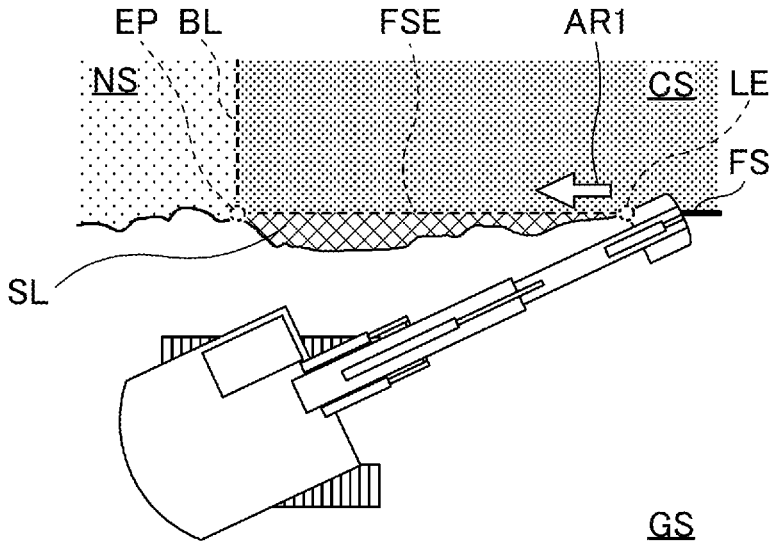
FIG. 11A is a top view of the shovel upon performing a slope toe forming process.
Figure 11B:
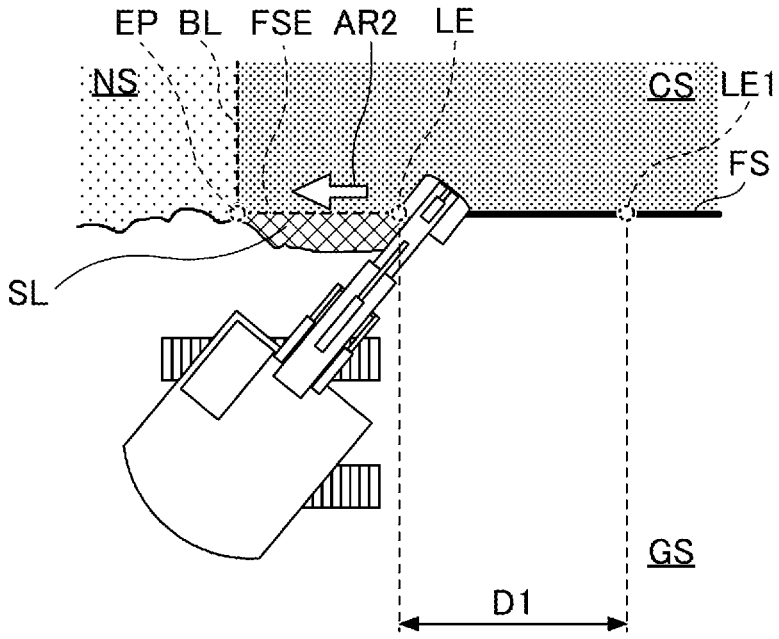
FIG. 11B is a top view of the shovel upon performing the slope toe forming process.
Figure 11C:
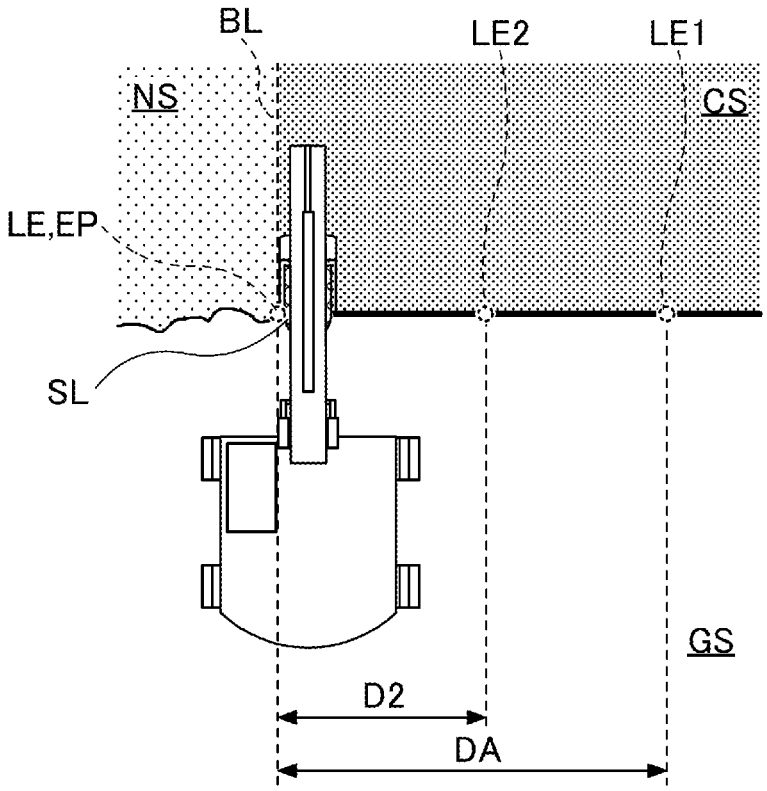
FIG. 11C is a top view of the shovel upon performing the slope toe forming process.
Figure 12:
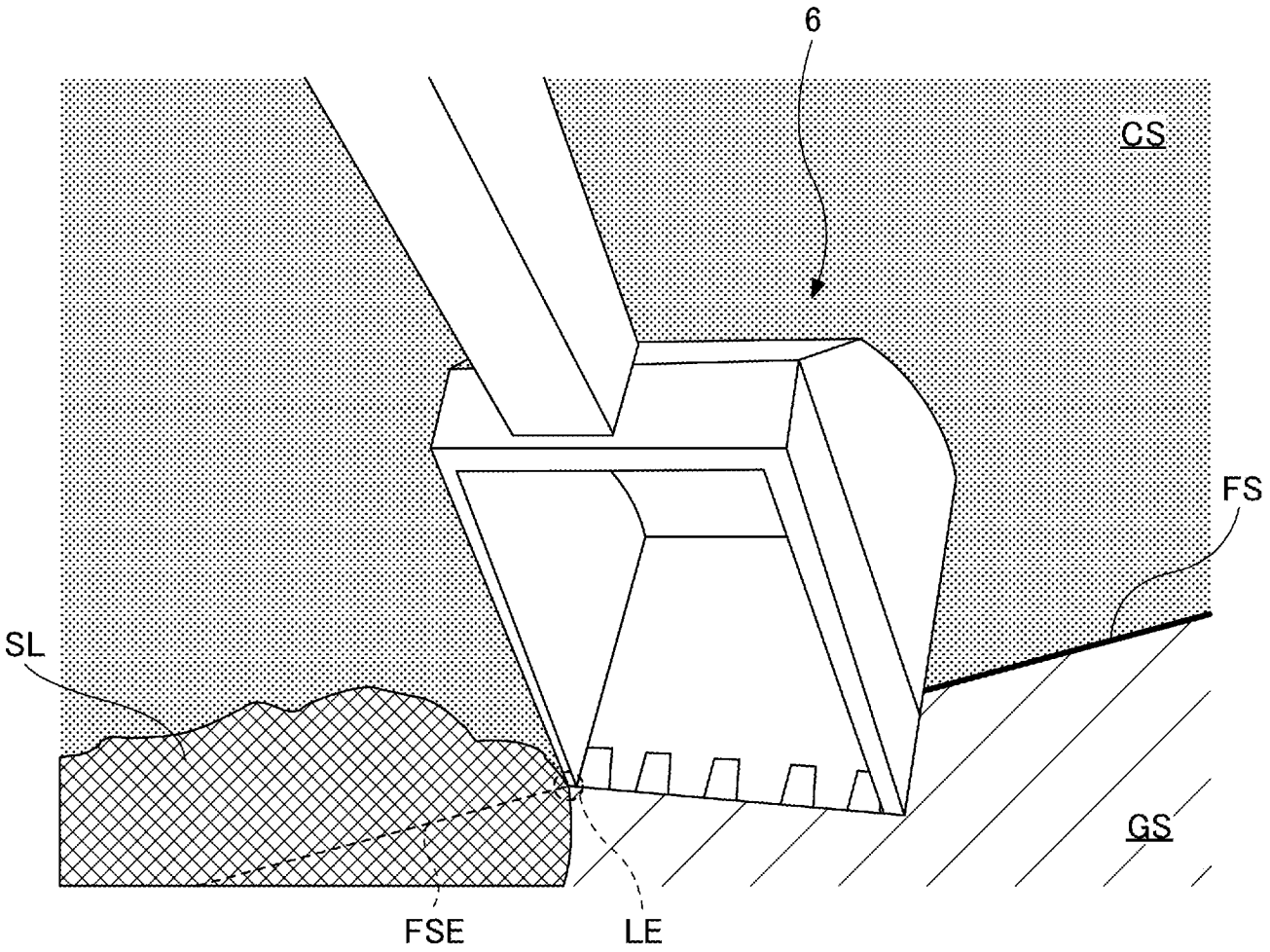
FIG. 12 is a perspective view of a bucket upon performing the slope toe forming process.

Next, with reference to FIG. 11A to FIG. 11C and FIG. 12, a process in which the machine control device 50 assists formation of the slope toe FS with the "finishing control mode" being set (slope toe forming process) will be described. FIG. 11A to FIG. 11C are each a top view of the shovel 100 that forms the slope toe. Specifically, FIG. 11A is a top view of the shovel 100 in which a left end LE of the toe of the bucket 6 is positioned at the slope toe FS of the backslope BS (region CS). FIG. 11B illustrates a state in which the left end LE of the toe is moved by a distance D1 in a direction indicated by an arrow AR1 (leftward) from the state as illustrated in FIG. 11A. A point LE1 in FIG. 11B indicates the position of the left end LE in the state as illustrated in FIG. 11A. FIG. 11C illustrates a state in which the left end LE of the toe is further moved by a distance D2 in a direction indicated by an arrow AR2 (leftward) from the state as illustrated in FIG. 11B. A point LE2 in FIG. 11C indicates the position of the left end LE in the state as illustrated in FIG. 11B. A distance DA is the sum of the distance D1 and the distance D2. Note that, in FIG. 11A to FIG. 11C, for ease of understanding, the region NS, in which the backslope BS is not completed, is given a rough dot pattern, and the region CS, in which the backslope BS is completed, is given a fine dot pattern. Also, in FIG. 11A to FIG. 11C, a cross pattern is given to soil and sand SL deposited near the slope toe FS after rolling down over the backslope BS upon the slope finishing operation. Also, it is illustrated in FIG. 11A to FIG. 11C that a straight boundary line corresponding to the slope toe FS as in the region CS (boundary line between the backslope BS and the ground surface GS on which the shovel 100 is located) has not yet been formed at the lower end portion of the region NS. FIG. 12 is a perspective view of the bucket 6 in the state as illustrated in FIG. 11A when the bucket 6 is viewed from the interior of the cab 10.

In the examples as illustrated in FIG. 11A to FIG. 11C, after repeating the slope finishing process as illustrated in FIG. 10A and FIG. 10B twice or more, the operator of the shovel 100, as illustrated in FIG. 11A, swivels the upper swiveling body 3 and extends the excavating attachment, thereby contacting the left end LE of the toe of the bucket 6 with the slope toe FS. The position with which the left end LE is brought into contact is, for example, the closest position, on the finished slope toe FS, to the shovel 100. The finished slope toe FS means a state in which the soil and sand SL are removed and the boundary line between the backslope BS and the ground surface GS is exposed.

Note that, the machine control device 50 may be configured to assist an operation for contacting the left end LE with the slope toe FS. In this case, for example, when the right operation lever 26R is operated in the boom lowering direction with the switch SW1 being pressed, the automatic control part 54 may automatically operate the excavating attachment so that the end portion of the toe of the bucket 6 contacts the slope toe FS. When the left end LE of the toe of the bucket 6 reaches the slope toe FS, the automatic control part 54 stops the movement of the excavating attachment. In the examples as illustrated in FIG. 11A to FIG. 11C, even if the left operation lever 26L is being operated in the boom lowering direction, the automatic control part 54 stops the movement of the excavating attachment.

Subsequently, the operator of the shovel 100 performs the slope toe forming process by operating the left operation lever 26L in the leftward swiveling direction while pressing the switch SW1. When the left operation lever 26L is operated in the leftward swiveling direction with the switch SW1 being pressed, the automatic control part 54 starts performing the slope toe forming process, and automatically operates the excavating attachment so that the left end LE of the toe of the bucket 6 moves along an extension FSE of the finished slope toe FS. That is, the extension FSE of the slope toe FS is the target line. The target line is a part of the target construction surface. Specifically, the automatic control part 54 automatically performs a left swiveling movement, a boom raising movement, an arm closing movement, and a bucket opening movement.

When the attachments including the arm 5, the boom 4, and the like are moved based on the swiveling movement, the attachments are controlled in accordance with the swiveling movement. Specifically, when the bucket 6 is swiveled into the ground in a direction exceeding the target construction surface, the controller 30 controls the attachments to be closed so that the bucket 6 does not exceed the target construction surface (target line). For example, the controller 30 performs the arm closing movement and the boom raising movement. When the bucket 6 is swiveled away from the ground in a direction farther from the target construction surface, the controller 30 controls the attachments to be opened so that the bucket 6 contours the target construction surface (target line). For example, the controller 30 performs the arm opening movement and the boom lowering movement.

When the swiveling movement is based on the movement of the attachment, the swiveling movement is controlled in accordance with the movement of the attachment (e.g., an arm movement or a boom movement). Specifically, when a rotation (opening and closing) movement of the attachment is performed in a direction in which the radius of swiveling increases (direction exceeding the target construction surface), the controller 30 controls the swiveling movement so that the bucket 6 does not exceed the target construction surface (target line). For example, the controller 30 controls the swiveling so that the bucket 6 moves in a direction away from the target construction surface. When a rotation (opening and closing) movement of the attachment is performed in a direction in which the radius of swiveling decreases (direction farther from the target construction surface), the controller 30 controls the swiveling movement so that the bucket 6 contours the target construction surface (target line). For example, the controller 30 controls the swiveling so that the bucket 6 moves in a direction closer to the target construction surface.

In order to predict the position of the bucket 6 on the target line after a predetermined time and move the bucket 6 to the predicted position, the controller 30 may generate a control command for the rotation (opening and closing) movement of the attachment and a control command for the swiveling movement, and control, for example, the arm movement, the boom movement, or both, and the swiveling movement.

Subsequently, the automatic control part 54, as illustrated in FIG. 11B, automatically operates the excavating attachment so that the left end LE of the toe of the bucket 6 moves along the extension FSE until the left end LE reaches an end point EP of the extension FSE. In the examples as illustrated in FIG. 11A to FIG. 11C, the end point EP is an intersection between a boundary line BL and the extension FSE of the slope toe FS. The boundary line BL is a boundary line between the region CS and the region NS. The distance DA as illustrated in FIG. 11C becomes the maximum when the point LE1 corresponds to the position of the left end LE of the toe of the bucket 6 at which the left end LE contacts the slope toe FS or the extension FSE at the maximum excavation radius (state in which the attachment is extended to the greatest extent possible). In the following, this maximum distance is referred to as distance Dmax. Note that, the automatic control part 54 may stop the automatic movement of the excavating attachment before the left end LE of the toe of the bucket 6 reaches the end point EP of the extension FSE. This is for the operator to be able to remove the soil and sand included in the bucket 6 backward of the shovel 100. In this case, the automatic control part 54 may restart the movement of the left end LE along the extension FSE after removal of the soil and sand.

Subsequently, the automatic control part 54 stops the movement of the excavating attachment when the left end LE of the toe of the bucket 6 reaches the end point EP of the extension FSE of the slope toe FS. In the examples as illustrated in FIG. 11A to FIG. 11C, even if the left operation lever 26L is being operated in the leftward swiveling direction, the automatic control part 54 stops the movement of the excavating attachment.

At this time, most of the soil and sand SL deposited on the ground surface GS near the slope toe FS is, as illustrated in FIG. 11C, included in the bucket 6. Therefore, for example, the operator of the shovel 100 may perform the swiveling operation to remove the included soil and sand SL backward of the shovel 100.

Note that, in the examples as illustrated in FIG. 11A to FIG. 11C, the automatic control part 54, while performing the left swiveling movement, assists formation of the slope toe FS by moving the left end LE of the toe of the bucket 6 along the extension FSE of the finished slope toe FS. However, for assisting formation of the slope toe FS, the automatic control part 54 may perform a right swiveling movement and move the right end of the toe of the bucket 6 along the extension FSE of the finished slope toe FS. In this case, the automatic control part 54 may start performing the slope toe forming process when the left operation lever 26L is operated in a rightward swiveling direction with the switch SW1 being pressed.

Figure 13:
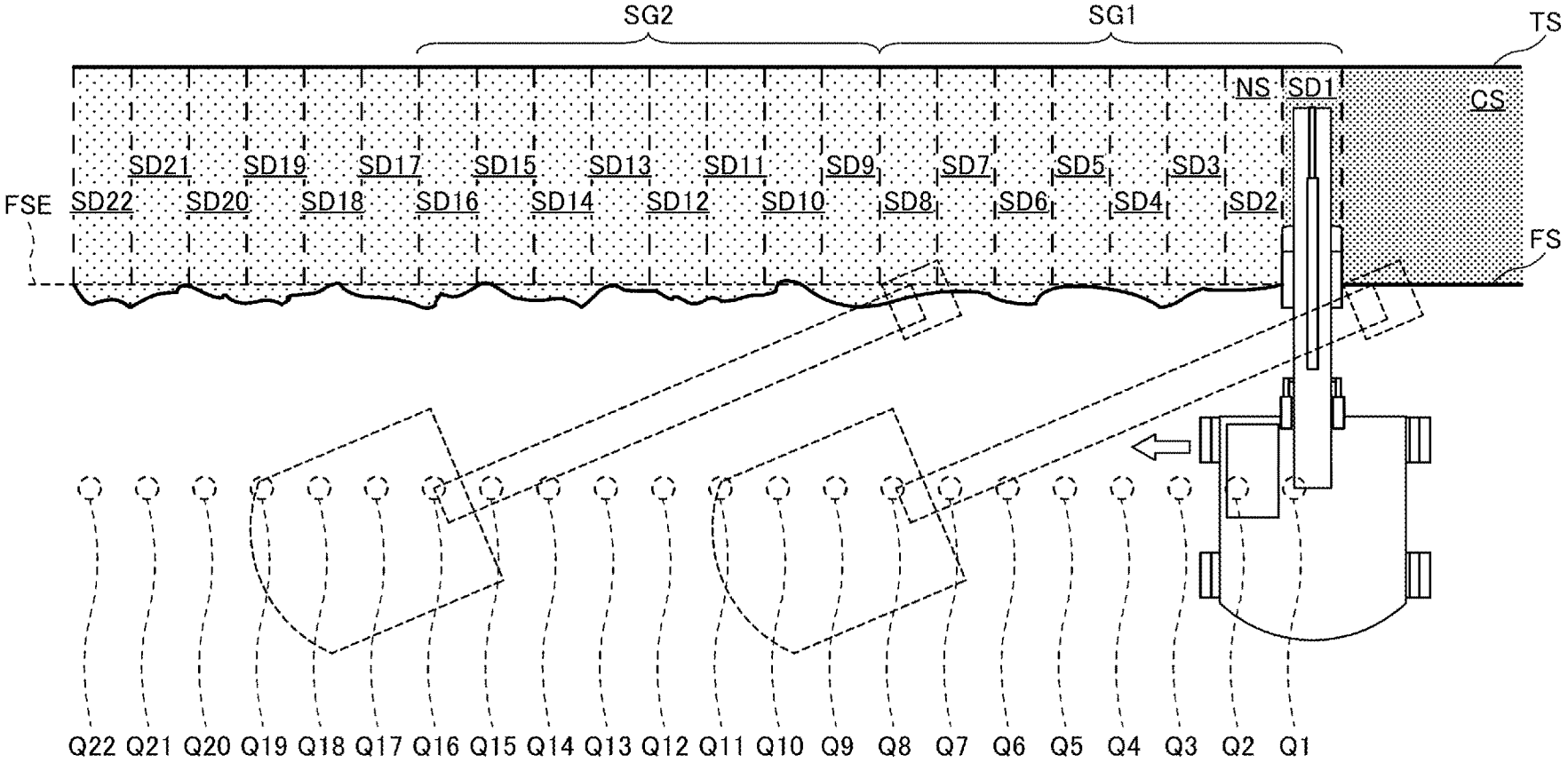
FIG. 13 is a top view of the shovel upon performing a travel assisting process.

Next, with reference to FIG. 13, a process in which the machine control device 50 assists the traveling operation by the operator of the shovel 100 (travel assisting process) will be described. FIG. 13 is a top view of the shovel 100 that performs the slope finishing operation and a slope toe forming operation. Note that, in FIG. 13, for ease of understanding, the region NS, in which the backslope BS is not completed, is given a rough dot pattern, and the region CS, in which the backslope BS is completed, is given a fine dot pattern.

Specifically, FIG. 13 illustrates a state of the shovel 100 that completes the slope finishing process of a first section SD1 of the backslope BS. After this, the operator of the shovel 100 intends to perform the slope finishing operation of a second section SD2 and subsequent sections of the backslope BS.

Note that, dashed-line circles as illustrated in FIG. 13 represent positions of swiveling axes of the shovel 100, and a dashed-line circle Q1 represents the position of the swiveling axis when the slope finishing process of the first section SD1 is performed.

For example, when the traveling lever 26D is operated with the switch SW2 being pressed after completion of the slope finishing process of the first section SD1, the automatic control part 54 automatically operates the traveling hydraulic motor 2M so that the swiveling axis is positioned at a position indicated by a dashed-line circle Q2. The position of the dashed-line circle Q2 is one of the first target stop positions set for performing the slope finishing operation. The first target stop position is, for example, set as a position away from the slope by a certain distance. Typically, the first target stop position is set as such a position that the shovel 100 that stops at the first target stop position can position the toe of the bucket 6 at the slope top TS and the slope toe FS. The controller 30 may determine whether or not the shovel 100 that stops at the first target stop position can position the toe of the bucket 6 at the slope top TS and at the slope toe FS, and display a determination result on the display device 45.

Specifically, the automatic control part 54 automatically performs the traveling movement. Subsequently, the automatic control part 54 stops the movement of the traveling hydraulic motor 2M when the swiveling axis is positioned at a position indicated by the dashed-line circle Q2. In the example as illustrated in FIG. 13, when both of the left traveling lever 26DL and the right traveling lever 26DR are operated in the traveling forward direction with the switch SW2 being pressed, the automatic control part 54 starts a leftward movement of the lower traveling body 1. This is because, in the example as illustrated in FIG. 13, the forward direction of the lower traveling body 1 corresponds to the leftward direction in the figure (direction indicated by a block arrow). However, in a case of the forward direction of the lower traveling body 1 corresponding to the rightward direction in the figure, when both of the left traveling lever 26DL and the right traveling lever 26DR are operated in the traveling backward direction with the switch SW2 being pressed, the automatic control part 54 may start the leftward movement of the lower traveling body 1. Note that, when the left traveling lever 26DL, the right traveling lever 26DR, or both are operated with the switch SW2 being pressed, the automatic control part 54 may start the leftward movement of the lower traveling body 1.

Subsequently, when the swiveling axis is positioned at a position indicated by the dashed-line circle Q2, even if the traveling lever 26D is being operated, the automatic control part 54 stops the movement of the traveling hydraulic motor 2M. Note that, the position of the dashed-line circle Q2 is determined in accordance with the position of the backslope BS that is the target construction surface, and information related to the target construction surface is stored in the storage device 47 in advance.

Subsequently, as needed, the operator of the shovel 100 performs the straight facing process to thereby cause the shovel 100 to face the second section SD2 of the backslope BS straight, and performs the slope finishing process to thereby complete finishing of the second section SD2 of the backslope BS.

Specifically, when the left operation lever 26L is operated in the arm opening direction with the switch SW1 being pressed, the automatic control part 54 automatically operates the excavating attachment so that the toe of the bucket 6 is positioned at the slope top TS of the backslope BS. Specifically, the automatic control part 54 automatically performs the boom lowering movement, the arm opening movement, and the bucket opening movement. Subsequently, the automatic control part 54 stops the movement of the excavating attachment when the toe of the bucket 6 is positioned at the slope top TS. Subsequently, when the left operation lever 26L is operated in the arm closing direction with the switch SW1 being pressed, the automatic control part 54 moves the toe of the bucket 6 from the slope top TS to the slope toe FS over the backslope BS that is the target construction surface. Subsequently, the automatic control part 54 stops the movement of the excavating attachment when the toe of the bucket 6 reaches the slope toe FS.

Subsequently, the automatic control part 54 repeats the above movement until completion of the slope finishing process of an eighth section SD8. Specifically, after completion of the slope finishing process of the second section SD2, the automatic control part 54 automatically operates the traveling hydraulic motor 2M so that the swiveling axis is positioned at a position indicated by a dashed-line circle Q3. Similarly, after completion of the slope finishing process of a third section SD3, the automatic control part 54 automatically operates the traveling hydraulic motor 2M so that the swiveling axis is positioned at a position indicated by a dashed-line circle Q4. After completion of the slope finishing process of a fourth section SD4, the automatic control part 54 automatically operates the traveling hydraulic motor 2M so that the swiveling axis is positioned at a position indicated by a dashed-line circle Q5. After completion of the slope finishing process of a fifth section SD5, the automatic control part 54 automatically operates the traveling hydraulic motor 2M so that the swiveling axis is positioned at a position indicated by a dashed-line circle Q6. After completion of the slope finishing process of a sixth section SD6, the automatic control part 54 automatically operates the traveling hydraulic motor 2M so that the swiveling axis is positioned at a position indicated by a dashed-line circle Q7. After completion of the slope finishing process of a seventh section SD7, the automatic control part 54 automatically operates the traveling hydraulic motor 2M so that the swiveling axis is positioned at a position indicated by a dashed-line circle Q8. The distance from the dashed-line circle Q1 to the dashed-line circle Q8 is set to be shorter than or equal to the distance Dmax.

After completion of the slope finishing process of the eighth section SD8, the automatic control part 54 performs the slope toe forming process. At this time, the shovel 100 directs the upper swiveling body 3 backward (downward in the figure) for removing the soil and sand included in the bucket 6. Specifically, the operator of the shovel 100 performs the slope toe forming process by operating the left operation lever 26L in the leftward swiveling direction while pressing the switch SW1. When the left operation lever 26L is operated in the leftward swiveling direction with the switch SW1 being pressed, the automatic control part 54 starts performing the slope toe forming process, and automatically operates the excavating attachment so that the left end LE of the toe of the bucket 6 moves along the extension FSE of the finished slope toe FS. More specifically, as illustrated in FIG. 13, after the left end LE of the toe of the bucket 6 is positioned at the right-lower corner of the first section SD1, the automatic control part 54 automatically performs the left swiveling movement, the boom raising movement, the arm closing movement, and the bucket opening movement. Then, the automatic control part 54 moves the left end LE of the toe of the bucket 6 to the left-lower corner of the eighth section SD8 along the extension FSE of the finished slope toe FS.

Note that, in the example as illustrated in FIG. 13, the automatic control part 54 is configured to perform the slope toe forming process with the swiveling axis being positioned at the position indicated by the dashed-line circle Q8. That is, the first target stop position set for performing the slope finishing operation (the position indicated by the dashed-line circle Q8) and a second target stop position set for performing the slope toe forming operation (the position indicated by the dashed-line circle Q8) are set to overlap each other. However, the automatic control part 54 may move the lower traveling body 1 to a position suitable for performing the slope toe forming process of the first section SD1 to the eighth section SD8 (one of the second target stop positions). That is, the first target stop position (the position indicated by the dashed-line circle Q8) and the second target stop position may be set to be different from each other.

Note that, in the following, a plurality of sections whose slope toes are formed at approximately the same timing by the slope toe forming process performed once are referred to as a "section set". In the example as illustrated in FIG. 13, the first section SD1 to the eighth section SD8 form a first section set SG1, and a ninth section SD9 to a sixteenth section SD16 form a second section set SG2.

Subsequently, when the traveling lever 26D is operated with the switch SW2 being pressed after completion of the slope toe forming process of the first section set SG1, the automatic control part 54 automatically operates the traveling hydraulic motor 2M so that the swiveling axis is positioned at a position indicated by a dashed-line circle Q9. This is to perform the slope finishing process of a ninth section SD9.

Subsequently, the automatic control part 54 repeats the slope finishing process and the travel assisting process until completion of the slope finishing process of the second section set, i.e., until completion of the slope finishing process of the sixteenth section SD16.

After completion of the slope finishing process of the sixteenth section SD16, the automatic control part 54 performs the slope toe forming process of the second section set SG2. Specifically, as illustrated in FIG. 13, after the left end LE of the toe of the bucket 6 is positioned at the right-lower corner of the ninth section SD9, the automatic control part 54 automatically performs the left swiveling movement, the boom raising movement, the arm closing movement, and the bucket opening movement. Then, the automatic control part 54 moves the left end LE of the toe of the bucket 6 to the left-lower corner of the sixteenth section SD16 along the extension FSE of the finished slope toe FS.

Note that, in the example as illustrated in FIG. 13, the automatic control part 54 is configured to perform the slope finishing operation of the first section set SG1, next, perform the slope toe forming process of the first section set SG1, and next, perform the slope finishing operation of the second section set SG2. That is, for example, the automatic control part 54 is configured to perform a series of processes while moving the shovel 100 leftward. After that, the automatic control part 54 stops the lower traveling body 1 at one of the first target stop positions (the position indicated by the dashed-line circle Q7) so as to perform the slope finishing process of one section (the seventh section SD7), next stops the lower traveling body 1 at one of the second target stop positions (the position indicated by the dashed-line circle Q8) so as to perform the slope finishing process of another section (the eighth section SD8) and the slope toe forming operation of one section set (the first section SD1 to the eighth section SD8), and next stops the lower traveling body 1 at another one of the first target stop positions (the position indicated by the dashed-line circle Q9) so as to perform the slope finishing process of still another section (the ninth section SD9).

However, for example, the automatic control part 54 may be configured to perform the slope toe forming operation after completion of the slope finishing operation of all of the sections. In this case, for example, the automatic control part 54 may be configured to perform a series of slope finishing processes while moving the shovel 100 leftward and to perform a series of slope toe forming processes while moving the shovel 100 rightward. In this case, for example, the automatic control part 54 may stop the lower traveling body 1 at one of the first target stop positions (the position indicated by the dashed-line circle Q8) so as to perform the slope finishing process of one section (the eighth section SD8) belonging to one section set (the first section set SG1) and next stop the lower traveling body 1 at another one of the first target stop positions (the position indicated by the dashed-line circle Q9) so as to perform the slope finishing process of one section (the ninth section SD9) belonging to another section set (the second section set SG2). Also, for example, the automatic control part 54 may stop the lower traveling body 1 at one of the second target stop positions (the position indicated by the dashed-line circle Q16) so as to perform the slope toe forming operation of one section set (the second section set SG2) and next stop the lower traveling body 1 at another one of the second target stop positions (the position indicated by the dashed-line circle Q9) so as to perform the slope toe forming operation of another section set (the first section set SG1). The distance from the dashed-line circle Q9 to the dashed-line circle Q16 is set to be shorter than or equal to the distance Dmax.

In this way, the shovel 100 according to the embodiment of the present disclosure includes: the lower traveling body 1; the upper swiveling body 3 mounted to the lower traveling body 1; attachments (excavating attachment) including the boom 4 attached to the upper swiveling body 3, the arm 5 attached to an end of the boom 4, and the bucket 6, which is the end attachment, attached to an end of the arm 5; and the machine control device 50, which is the control device, configured to control swiveling of the upper swiveling body 3 and movement of the excavating attachments so that the left end or the right end of the toe of the bucket 6 moves along the extension FSE of the slope toe FS, which is the target line. Although in the present embodiment, the control of the left end or the right end of the bucket 6 relative to the slope toe FS has been described, the present invention can also be applied to a shovel having a bucket tilt mechanism. For the shovel having the bucket tilt mechanism, the controller 30 may control swiveling of the upper swiveling body 3 and movement of the excavating attachments so that an end portion (toe or back surface) of a tilt bucket moves along the target construction surface (formed with a plurality of target lines). In this case, the controller 30 can control a tilt bucket-including attachment in response to a swiveling movement, and readily assist the finishing operation of the target construction surface. Also, the controller 30 may control swiveling of the upper swiveling body 3 and movement of the excavating attachments so that the end portion of the bucket 6 (the left end or the right end of the back surface) moves along the target construction surface (formed with a plurality of target lines). In this case, the controller 30 can perform the swiveling operation while the target construction surface is being contoured by a straight portion of the left end or the right end of the back surface of the bucket 6, and assist the finishing operation of the target construction surface even if the bucket tilt mechanism is not provided. In this way, the controller 30 can automatically control a predetermined portion of the bucket 6 so as to move over the target construction surface in response to the arm operation performed by the operator. Moreover, the controller 30 automatically controls swiveling of the upper swiveling body 3 and movement of the attachments so that the predetermined portion of the bucket 6 moves over the target construction surface including the slope toe in response to the swiveling operation.

This configuration produces the effect of assisting the operator of the shovel 100 in forming the edge portions of the ground features such as the slope toe FS. For example, the operator of the shovel 100 can move the left end LE of the toe of the bucket 6 along the extension FSE of the slope toe FS by simply operating the left operation lever 26L in the leftward swiveling direction while pressing the switch SW1. Alternatively, for example, the operator of the shovel 100 can move the right end of the toe of the bucket 6 along the extension FSE of the slope toe FS by simply operating the left operation lever 26L in the rightward swiveling direction while pressing the switch SW1.

The target line may be, for example, the slope toe, the slope top, an edge of a channel, or a line along a corner of a bottom surface of an angled channel. As illustrated in FIG. 10A and FIG. 10B, the target line may be, for example, a line along the slope toe FS (the extension FSE of the slope toe FS) or a line along the slope top TS (the extension of the slope top TS). Alternatively, the target line may be a line along an edge of a channel such as a U-shaped channel or a quadrangular channel, or may be a line along a corner of a bottom surface of an angled channel such as a quadrangular channel (corner between a channel wall surface and a channel bottom surface).

The machine control device 50 may be configured to perform a combined movement including the swiveling movement, the boom raising movement, and the arm closing movement, and move the left end or the right end of the end attachment along the target line. As illustrated in FIG. 11A to FIG. 11C, the machine control device 50 may be, for example, configured to perform a combined movement including the left swiveling movement, the boom raising movement, and the arm closing movement, and move the left end LE of the toe of the bucket 6 along the extension FSE of the slope toe FS. With this configuration, the machine control device 50 can efficiently remove the soil and sand SL deposited around the slope toe FS.

The machine control device 50 may be configured to control swiveling of the upper swiveling body 3 and movement of the attachments so that the left end or the right end of the end attachment moves along the target line when the swiveling operation lever is operated with a predetermined switch being operated. For example, the machine control device 50 may be configured to control leftward swiveling of the upper swiveling body 3 and movement of the excavating attachment so that the left end LE of the toe of the bucket 6 moves along the extension FSE of the slope toe FS as illustrated in FIG. 11A to FIG. 11C when the left operation lever 26L is operated in the leftward swiveling direction with the switch SW1, which is a push-button switch provided at the end of the left operation lever 26L, being pressed. With this configuration, the operator of the shovel 100 can form the slope toe FS with simple operations.

The length of the target line set upon performing the slope toe forming process is twice or greater the width of the bucket 6 and is less than a radius of operation. The radius of operation is, for example, a distance between the swiveling axis and the toe of the bucket 6 when the excavating attachment is extended to the greatest extent possible in a direction perpendicular to the swiveling axis. With this configuration, the operator of the shovel 100 performs the slope toe forming process after performing the slope finishing operation twice or more, and can scoop up and remove at one time, with the bucket 6, the soil and sand SL deposited near the slope toe FS after rolling down over the backslope BS upon performing the slope finishing operation twice or more.

Also, according to the shovel 100 according to the embodiment of the present disclosure, the controller 30 may be configured to control the movement of the lower traveling body 1 so that the lower traveling body 1 stops at the target stop position set based on the position of the edge portion of the target construction surface. For example, the controller 30 may be configured to set the target stop position at which the lower traveling body 1 stops so as to remove, with the attachments, the soil and sand deposited at the edge portion of the target construction surface. The target construction surface is, for example, a slope (backslope BS) and the edge portion is the slope toe FS or the slope top TS.

The target stop position may include: first target stop positions that are correspondingly set to a plurality of sections to be subjected to the slope finishing operation; and second target stop positions that are correspondingly set to section sets each formed with two or more continuous sections of the plurality of sections. The first target stop position and the second target stop position may overlap each other. In the example as illustrated in FIG. 13, the target stop position includes: the first target stop positions (the positions indicated by the dashed-line circle Q1 to a dashed-line circle Q22) that are correspondingly set to the first section SD1 to a twenty-second section SD22; and the second target stop positions (the positions indicated by the dashed-line circle Q8 and the dashed-line circle Q16) that are correspondingly set to the section sets each formed with two or more continuous sections of the plurality of sections (e.g., the first section set SG1 and the second section set SG2). The machine control device 50 may set, as a target traveling route, a line connecting the first target stop positions (the positions indicated by the dashed-line circle Q1 to the dashed-line circle Q22) and moves the lower traveling body 1 along the target traveling route.

This configuration produces the effect of assisting the operator of the shovel 100 in forming the edge portions of the ground features such as the slope toe FS. For example, the operator of the shovel 100 can move the shovel 100 (lower traveling body 1) to a position suitable for performing the slope finishing process by simply operating the traveling lever 26D while pressing the switch SW2. Also, for example, the operator of the shovel 100 can move the shovel 100 (lower traveling body 1) to a position suitable for performing the slope toe forming process by simply operating the traveling lever 26D while pressing the switch SW2. Note that, the target construction surface may be, for example, the wall surface of a channel. In this case, the edge portion may be an edge of that channel, or the corner between the wall surface and the bottom surface of that channel.

In the above, the embodiments of the present invention have been described in detail. However, the present invention is not limited to the above-described embodiments or the below-described embodiments. Various modifications, substitutions, or the like can be applied in the above-described or below-described embodiments without departing from the scope of the present invention. In addition, the features that have been separately described can be combined together unless there occurs any technical contradiction.

For example, in the above-described embodiments, the extension FSE of the slope toe FS extends in the form of a straight line, but may include a curved portion.

What is claimed is:

1. A shovel, comprising:

a lower traveling body;

an upper swiveling body mounted to the lower traveling body;

an attachment including a boom attached to the upper swiveling body, an arm attached to an end of the boom, and an end attachment attached to an end of the arm; and a hardware processor configured to control swiveling of the upper swiveling body and movement of the attachment so that a left end or a right end of the end attachment moves so as to coincide with a target line, wherein a length of the target line is less than a radius of operation.

2. The shovel according to claim 1, wherein the target line is a slope toe, a slope top, an edge of a channel, or a line along a corner of a bottom surface of a quadrangular channel.

3. The shovel according to claim 1, wherein the hardware processor is configured to perform a combined movement including a swiveling movement, a boom raising movement, and an arm closing movement, and moves the left end or the right end of the end attachment along the target line.

4. The shovel according to claim 1, wherein the hardware processor is configured to, in response to operation of a swiveling operation lever with a predetermined switch being operated, control the swiveling of the upper swiveling body and the movement of the attachment so that the left end or the right end of the end attachment moves along the target line.

5. The shovel according to claim 1, wherein the target line is a line extending in a form of a straight line.

6. The shovel according to claim 1, wherein the hardware processor is configured to set a target stop position at which the lower traveling body stops so as to remove, with the attachment, soil and sand deposited at an edge portion of a target construction surface.

7. The shovel according to claim 6, wherein the target stop position includes first target stop positions corresponding to a plurality of sections to be subjected to a slope finishing operation, and second target stop positions corresponding to section sets each formed with two or more continuous sections of the plurality of sections.

8. The shovel according to claim 7, wherein the hardware processor is configured to stop the lower traveling body at one of the first target stop positions, next stop the lower traveling body at one of the second target stop positions, and next stop the lower traveling body at another one of the first target stop positions.

9. The shovel according to claim 6, wherein the target construction surface is a wall surface of a channel, and the edge portion is an edge of the channel, or a corner between the wall surface and a bottom surface of the channel.

10. A control device for a shovel that includes a lower traveling body, an upper swiveling body mounted to the lower traveling body, and an attachment including a boom attached to the upper swiveling body, an arm attached to an end of the boom, and an end attachment attached to an end of the arm, the control device comprising:

a hardware processor configured to control swiveling of the upper swiveling body and movement of the attachment so that a left end or a right end of the end attachment moves so as to coincide with a target line, wherein a length of the target line is less than a radius of operation.

11. The control device for the shovel according to claim 10, wherein the hardware processor is configured to set a target stop position at which the lower traveling body stops so as to remove, with the attachment, soil and sand deposited at an edge portion of a target construction surface.

* * * * *